US012454805B2

(12) United States Patent
Yamaguchi

(10) Patent No.: US 12,454,805 B2
(45) Date of Patent: Oct. 28, 2025

(54) WORK MACHINE

(71) Applicant: KOMATSU LTD., Tokyo (JP)

(72) Inventor: Masaho Yamaguchi, Tokyo (JP)

(73) Assignee: KOMATSU LTD., Tokyo (JP)

( * ) Notice: Subject to any disclaimer, the term of this patent is extended or adjusted under 35 U.S.C. 154(b) by 0 days.

(21) Appl. No.: 18/274,302

(22) PCT Filed: Jan. 17, 2022

(86) PCT No.: PCT/JP2022/001380
§ 371 (c)(1),
(2) Date: Jul. 26, 2023

(87) PCT Pub. No.: WO2022/168582
PCT Pub. Date: Aug. 11, 2022

(65) Prior Publication Data

US 2024/0084546 A1 Mar. 14, 2024

(30) Foreign Application Priority Data

Feb. 3, 2021 (JP) ..... 2021-016061

(51) Int. Cl.
*E02F 3/42* (2006.01)
*E02F 9/22* (2006.01)

(52) U.S. Cl.
CPC ..... *E02F 3/427* (2013.01); *E02F 3/425* (2013.01); *E02F 9/2296* (2013.01)

(58) Field of Classification Search
CPC ..... E02F 3/425; E02F 3/427; E02F 9/2296
See application file for complete search history.

(56) References Cited

U.S. PATENT DOCUMENTS

2021/0316608 A1 10/2021 Marechal et al.
2022/0098827 A1* 3/2022 Fliearman ..... E02F 9/2095
2024/0183121 A1* 6/2024 Iitani ..... E02F 9/2095
2024/0240429 A1* 7/2024 Iitani ..... F16H 57/0497

FOREIGN PATENT DOCUMENTS

CN 211368850 U 8/2020
CN 112252384 A 1/2021
FR 3084623 A1 2/2020
JP S63-051533 A 3/1988
JP S6351533 A * 3/1988
(Continued)

*Primary Examiner* — Saul Rodriguez
*Assistant Examiner* — Brendan P Tighe
(74) *Attorney, Agent, or Firm* — Faegre Drinker Biddle & Reath LLP

(57) ABSTRACT

An environment-friendly work machine is provided. A work implement includes a boom supported by a vehicular body frame, an arm coupled to the boom, and an attachment coupled to the arm. A boom foot pin rotatably couples the boom to the vehicular body frame. An arm motor is supported by the vehicular body frame. The arm motor generates drive force that moves the arm relatively to the boom. A motive power transmission apparatus mechanically transmits drive force generated by the arm motor to the arm. An arm gear member and a pivot member carry out rotational motion relative to the vehicular body frame as being concentric with the boom foot pin. An arm link transmits motive power to the arm as a result of the relative rotational motion.

11 Claims, 16 Drawing Sheets

(56) References Cited

FOREIGN PATENT DOCUMENTS

| | | | | |
|---|---|---|---|---|
| JP | H06-262561 | A | | 9/1994 |
| JP | H10-122311 | A | | 5/1998 |
| JP | 2003-239670 | A | | 8/2003 |
| JP | 2006152740 | A | * | 6/2006 |
| JP | 2015-190587 | A | | 11/2015 |
| JP | 2022119074 | A | * | 8/2022 |
| JP | 7660833 | B2 | * | 4/2025 |
| WO | 2012/157008 | A1 | | 11/2012 |

* cited by examiner

FIG.8

| CONTROL | OPERATION OF GEAR MEMBER | FIRST MOTOR | | SECOND MOTOR | | TOTAL TORQUE | EFFICIENCY (%) | POSITION ACCURACY OF LINK TIP | DAMAGE TO GEAR ON COLLISION OF LINK TIP END |
|---|---|---|---|---|---|---|---|---|---|
| | | OFFSET TORQUE | DRIVE TORQUE | OFFSET TORQUE | DRIVE TORQUE | | | | |
| CARRYING OUT BACKLASH ELIMINATION CONTROL | STANDSTILL | $\alpha$ | 0 | $-\alpha$ | 0 | 0 | 0 | HIGH | LOW IMPACT AND GEAR NOT BROKEN |
| | LOW-SPEED COUNTERCLOCKWISE ROTATION | $\alpha$ | T | $-\alpha$ | 0 | T | 66 | HIGH | LOW IMPACT AND GEAR NOT BROKEN |
| | LOW-SPEED CLOCKWISE ROTATION | $\alpha$ | 0 | $-\alpha$ | −T | −T | 66 | HIGH | LOW IMPACT AND GEAR NOT BROKEN |
| NOT CARRYING OUT BACKLASH ELIMINATION CONTROL | HIGH-SPEED COUNTERCLOCKWISE ROTATION | 0 | T | 0 | T | 2T | 100 | LOW | MOTOR STEPPING OUT TO PREVENT GEAR FROM BEING BROKEN |
| | HIGH-SPEED CLOCKWISE ROTATION | 0 | −T | 0 | −T | −2T | 100 | LOW | MOTOR STEPPING OUT TO PREVENT GEAR FROM BEING BROKEN |

WORK MACHINE

TECHNICAL FIELD

The present disclosure relates to a work machine.

BACKGROUND ART

Japanese Patent Laying-Open No. 2015-190587 (PTL 1) discloses a hydraulic excavator including a front work apparatus. The front work apparatus includes a boom, an arm, and a bucket. The boom is driven by a boom cylinder. The arm is driven by an arm cylinder. As a hydraulic pump is driven by an electric motor and hydraulic oil delivered by the hydraulic pump is supplied to the arm cylinder, the arm cylinder extends and contracts.

CITATION LIST

Patent Literature

PTL 1: Japanese Patent Laying-Open No. 2015-190587

SUMMARY OF INVENTION

Technical Problem

With increased interest in global environments in recent years, a work machine is also required to be more environment-friendly.

The present disclosure proposes a work machine more environment-friendly than a conventional work machine.

Solution to Problem

A work machine according to one aspect of the present disclosure includes a vehicular body frame, a work implement, a boom foot pin, an electric motor, and a motive power transmission apparatus. The work implement includes a boom supported by the vehicular body frame, an arm coupled to the boom, and an attachment coupled to the arm. The boom foot pin rotatably couples the boom to the vehicular body frame. The motor is supported by the vehicular body frame. The motor generates drive force that moves the arm relatively to the boom. The motive power transmission apparatus mechanically transmits drive force generated by the motor to the arm. The motive power transmission apparatus includes a first transmission portion that carries out rotational motion relative to the vehicular body frame as being concentric with the boom foot pin and a second transmission portion that transmits motive power to the arm as a result of the relative rotational motion of the first transmission portion.

A work machine according to one aspect of the present disclosure includes a vehicular body frame, a work implement, an electric motor, and a motive power transmission apparatus. The work implement includes a boom supported by the vehicular body frame and an attachment movable relatively to the boom. The motor generates drive force that moves the attachment relatively to the boom. The motive power transmission apparatus mechanically transmits drive force generated by the motor to the attachment. The motive power transmission apparatus includes a rack coupled to the attachment and a pinion meshed with the rack.

A work machine according to one aspect of the present disclosure includes a vehicular body frame, a work implement, an electric motor, and a motive power transmission apparatus. The work implement includes a boom supported by the vehicular body frame and an attachment movable relatively to the boom. The motor is mounted on the vehicular body frame. The motor generates drive force that moves the attachment relatively to the boom. The motive power transmission apparatus transmits drive force generated by the motor to the attachment. The motive power transmission apparatus includes a hydraulic pump driven by the motor to deliver pressure oil, a double-rod cylinder driven by the pressure oil delivered by the hydraulic pump, and a closed hydraulic circuit through which the hydraulic pump and the double-rod cylinder are connected to each other.

Advantageous Effects of Invention

According to the present disclosure, an environment-friendly work machine in which a work implement is electrically driven can be realized.

BRIEF DESCRIPTION OF DRAWINGS

FIG. 8 is a diagram showing control in double-motor drive.

DESCRIPTION OF EMBODIMENTS

Figure 1:
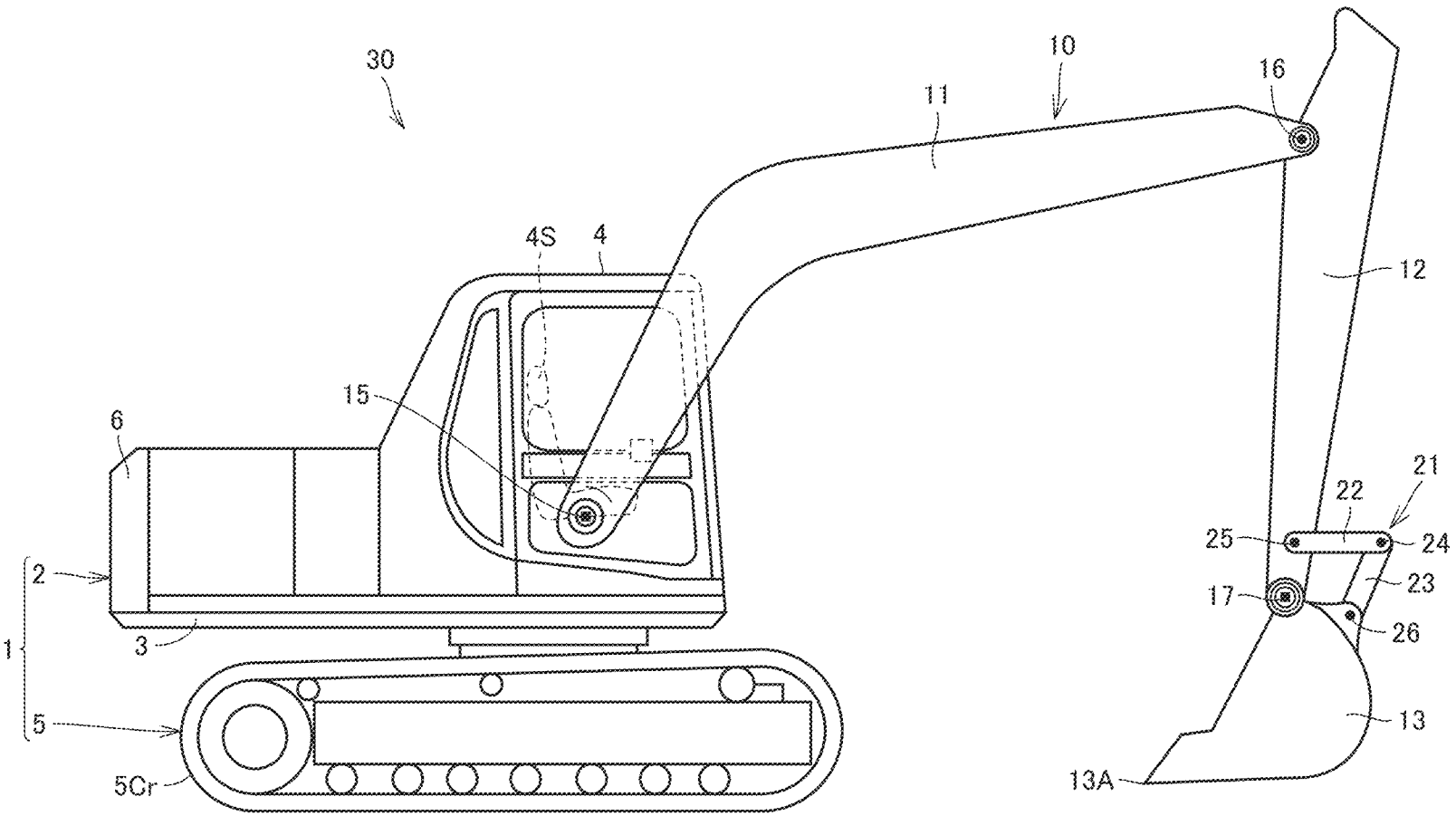
FIG. 1 is a side view schematically showing a construction of a work machine based on a first embodiment.

An embodiment will be described below with reference to the drawings. The same elements in the description below have the same reference characters allotted and their labels and functions are also the same. Therefore, detailed description thereof will not be repeated.

In the description below, "upward", "downward", "front", "rear", "left", and "right" refer to directions with an operator sitting in an operator's seat 4S in an operator's cab 4 being defined as the reference.

First Embodiment

<Overall Construction>

FIG. 1 is a side view schematically showing a construction of an electric excavator 30 as an exemplary work machine based on a first embodiment. FIG. 1 shows a general construction of electric excavator 30 when viewed from a right side. As shown in FIG. 1, electric excavator 30 in the embodiment mainly includes a revolving unit 2, a traveling unit 5, and a work implement 10. Revolving unit 2 and traveling unit 5 constitute a vehicular body 1 of electric excavator 30.

Traveling unit 5 includes a pair of left and right crawler belt apparatuses 5Cr. Each of the pair of left and right crawler belt apparatuses 5Cr includes a crawler belt. As the pair of left and right crawler belts is rotationally driven, electric excavator 30 is self-propelled. Traveling unit 5 may include a wheel (tire) instead of crawler belt apparatuses 5Cr.

Revolving unit 2 is provided as being revolvable with respect to traveling unit 5. Revolving unit 2 mainly includes a vehicular body frame 3, operator's cab (cab) 4, and a counterweight 6. Operator's cab 4 and counterweight 6 are mounted on vehicular body frame 3.

An operator gets on operator's cab 4 and operates electric excavator 30. Operator's cab 4 is arranged, for example, on a front left side of revolving unit 2 (a front side of a vehicle). In an internal space in operator's cab 4, operator's seat 4S where an operator takes a seat is arranged. Though electric excavator 30 is operated from the inside of operator's cab 4 in the present disclosure, electric excavator 30 may remotely be operated wirelessly from a location distant from electric excavator 30. Counterweight 6 is arranged on a rear side of revolving unit 2 (on a rear side of the vehicle) with respect to operator's cab 4. Counterweight 6 is arranged in the rear of revolving unit 2.

Work implement 10 is supported by revolving unit 2 on a front side of revolving unit 2, for example, on the right side of operator's cab 4. Work implement 10 includes a boom 11, an arm 12, and a bucket 13.

Boom 11 has a base end rotatably coupled to revolving unit 2 by a boom foot pin 15. Boom foot pin 15 extends in a lateral direction and passes through the base end of boom 11. Arm 12 has a base end rotatably coupled to a tip end of boom 11 by an arm coupling pin 16. Arm coupling pin 16 extends in the lateral direction and passes through the tip end of boom 11 and the base end of arm 12. Bucket 13 is rotatably coupled to a tip end of arm 12 by an attachment coupling pin 17. Attachment coupling pin 17 extends in the lateral direction and passes through the tip end of arm 12 and a base end of bucket 13.

Bucket 13 constitutes a tip end portion of work implement 10. Bucket 13 in the embodiment is coupled to boom 11 with arm 12 being interposed. As bucket 13 rotates around attachment coupling pin 17 and/or arm 12 rotates around arm coupling pin 16, bucket 13 moves relatively to boom 11. Bucket 13 is constructed to be movable relatively to boom 11.

Bucket 13 includes a plurality of blades. A tip end of bucket 13 is referred to as a cutting edge 13A. Bucket 13 does not have to include a blade. The tip end of bucket 13 may be formed from a steel plate in a straight shape.

Bucket 13 is an exemplary attachment removably attached to a tip end of work implement 10 and rotatable with respect to arm 12. Depending on a type of works, the attachment is replaced with a breaker, a grapple, a lifting magnet, or the like.

Work implement 10 includes a bucket link 21. Bucket link 21 includes a first member 22 and a second member 23. First member 22 and second member 23 are coupled as being rotatable relative to each other. First member 22 and second member 23 are coupled by means of a link pin 24. First member 22 is rotatably coupled to arm 12 by means of a link pin 25. Second member 23 is rotatably coupled to a bracket at a root portion of bucket 13 by means of a link pin 26.

First member 22 is in a rod shape. First member 22 is coupled to second member 23 at one end and coupled to arm 12 at the other end. Second member 23 is in a rod shape. Second member 23 is coupled to first member 22 at one end and coupled to bucket 13 at the other end.

Figure 2:
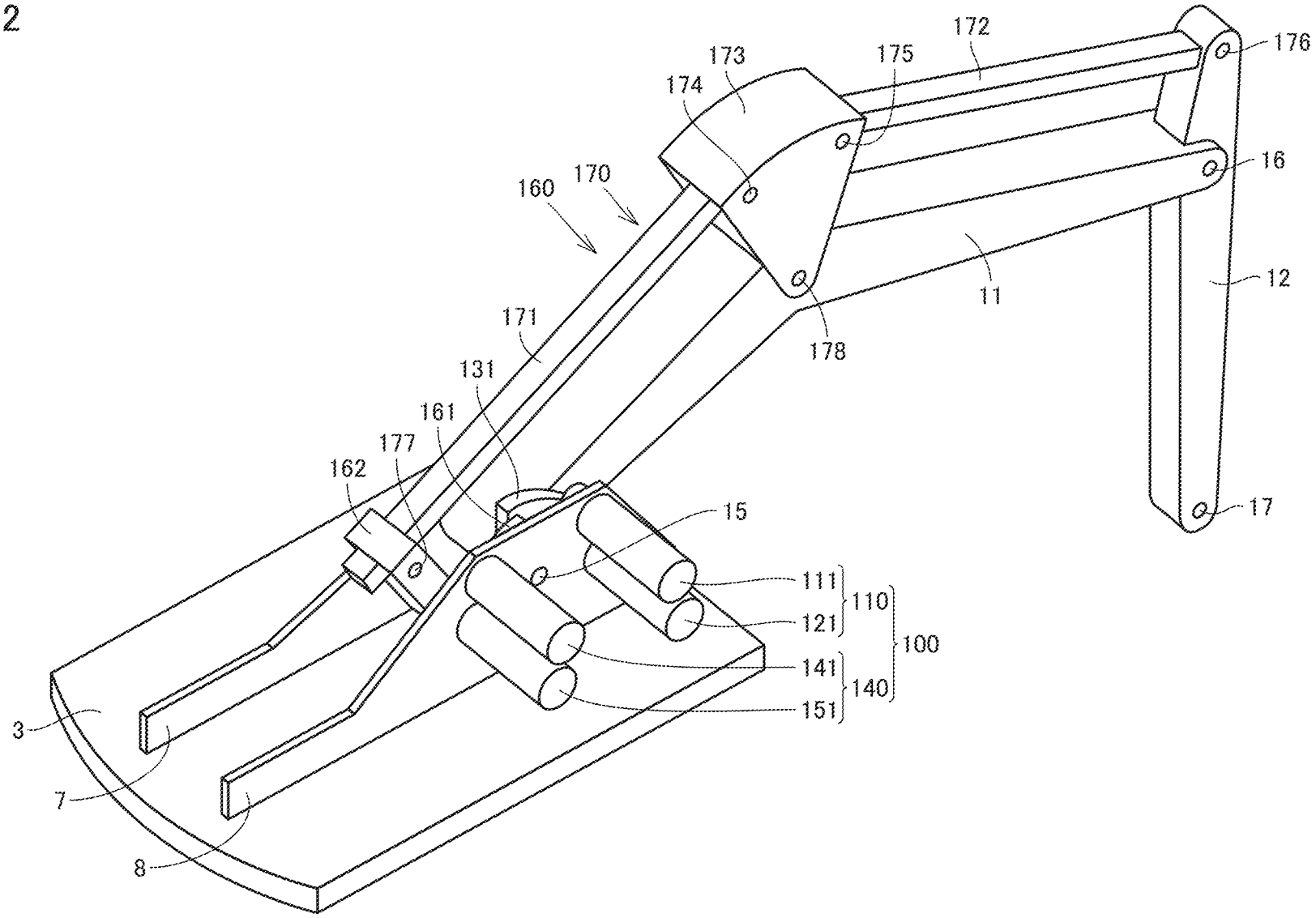
FIG. 2 is a perspective view of a vehicular body frame and a work implement.
Figure 3:
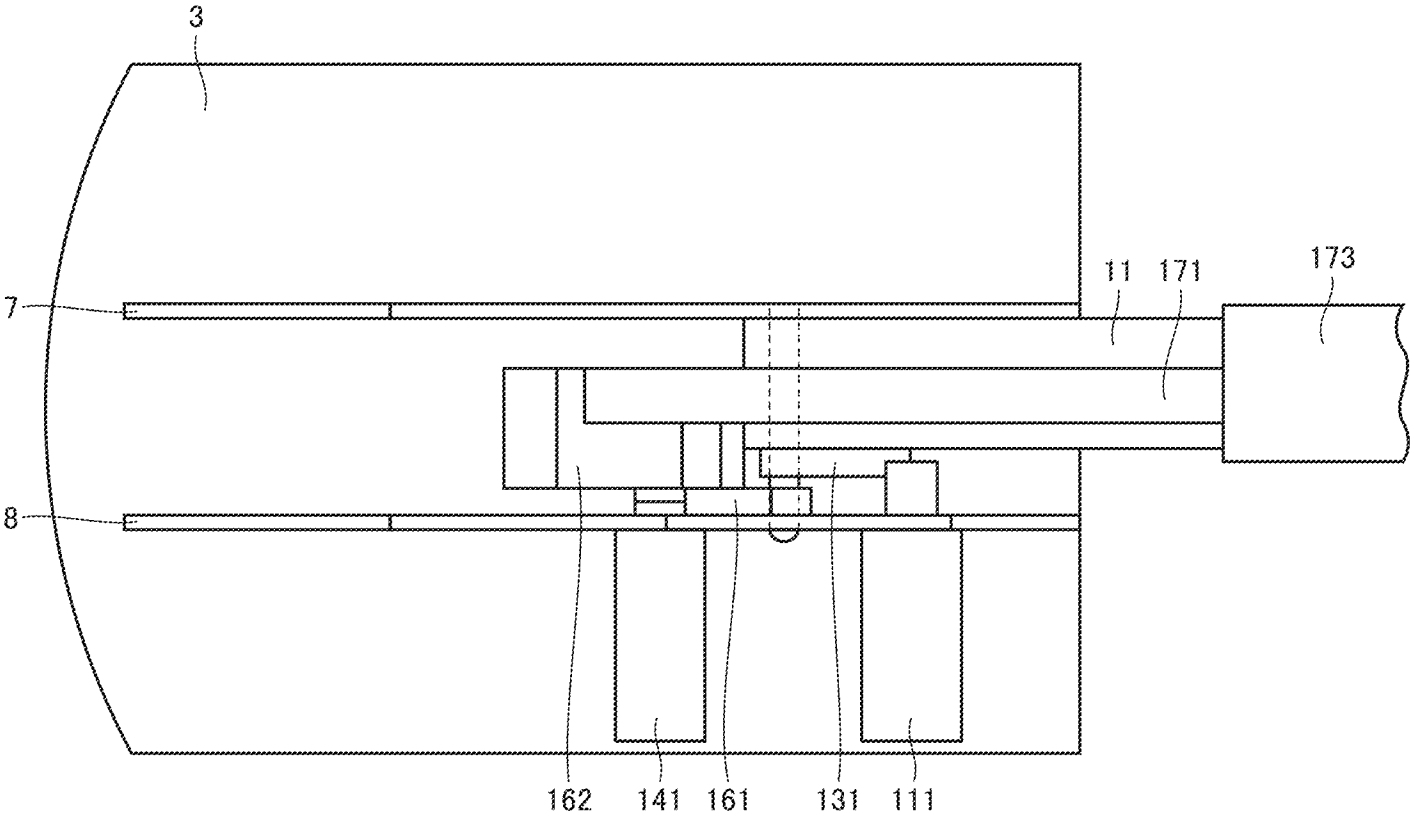
FIG. 3 is a plan view of the vehicular body frame and the work implement.

FIG. 2 is a perspective view of vehicular body frame 3 and work implement 10. FIG. 3 is a plan view of vehicular body frame 3 and work implement 10. Vehicular body frame 3 includes a pair of left and right vertical plates 7 and 8. Vertical plates 7 and 8 extend in a fore/aft direction (the lateral direction in FIG. 3). Vertical plates 7 and 8 are arranged at a distance in a width direction (lateral direction) of revolving unit 2. Vertical plates 7 and 8 are each formed from a plate erected in an upward/downward direction, and arranged at a distance from each other in the lateral direction. Operator's cab 4 is arranged on the left of left vertical plate 7. Work implement 10 is arranged between vertical plates 7 and 8 in the lateral direction. Work implement 10 is arranged on the right of left vertical plate 7 and on the left of right vertical plate 8.

<Electric Motor 100>

In electric excavator 30 in the embodiment, an electric motor 100 generates drive force to drive work implement 10. Motor 100 can drive work implement 10. As boom 11 and arm 12 are driven by motor 100, work implement 10 can operate. Motor 100 is arranged on vehicular body frame 3. Motor 100 includes a boom motor 110 and an arm motor 140. Boom motor 110 and arm motor 140 are each supported by vehicular body frame 3. Boom motor 110 and arm motor 140 are arranged on the right of work implement 10.

Boom motor 110 generates drive force to drive boom 11 and move boom 11 relatively to vehicular body frame 3. Being driven by boom motor 110, boom 11 is rotatable relatively to vehicular body frame 3 around boom foot pin 15. Boom foot pin 15 is arranged astride left and vertical plates 7 and 8. Boom foot pin 15 has a left end supported by left vertical plate 7 and has a right end supported by right vertical plate 8. Boom 11 is thus supported by vehicular body frame 3 rotatably around boom foot pin 15.

Boom motor 110 includes a pair of a first boom motor 111 and a second boom motor 121. First boom motor 111 and second boom motor 121 are identical to each other in specification. First boom motor 111 and second boom motor 121 are identical to each other in rated output. Rated output of the motor refers to maximum output that can safely be achieved by the motor under a designated condition.

Arm motor 140 generates drive force to drive arm 12 and move arm 12 relatively to boom 11. By being driven by arm motor 140, arm 12 is rotatable relatively to boom 11 around arm coupling pin 16.

Arm motor 140 includes a pair of a first arm motor 141 (first motor) and a second arm motor 151 (second motor). First arm motor 141 and second arm motor 151 are identical to each other in specification. First arm motor 141 and second arm motor 151 are identical to each other in rated output.

<Motive Power Transmission Apparatus>

Electric excavator 30 in the present embodiment includes a motive power transmission apparatus that mechanically transmits drive force generated by motor 100 to work implement 10. The motive power transmission apparatus will be described below.

Figure 4:
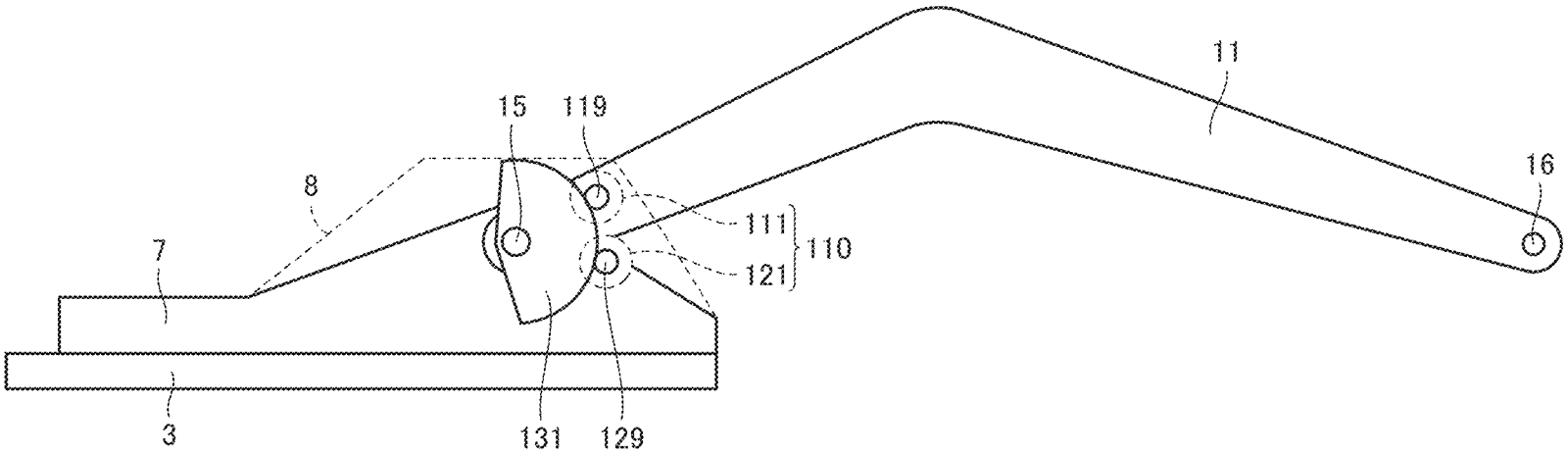
FIG. 4 is a diagram showing a general construction of a motive power transmission apparatus that transmits drive force to a boom.

FIG. 4 is a diagram showing a general construction of the motive power transmission apparatus that transmits drive force to boom 11. The motive power transmission apparatus includes a first boom output gear 119, a second boom output gear 129, and a boom gear member 131.

Boom gear member 131 is in a shape of a substantial sector and has a tooth profile in an arc portion of the substantial sector. As shown in FIGS. 2 and 3, boom gear member 131 is fixed to a side surface of boom 11, more specifically, a right surface of boom 11. Boom gear member 131 is arranged at the base end of boom 11. Boom gear member 131 is rotatable around boom foot pin 15 as being integrated with boom 11.

First boom output gear 119 is an external gear and it is meshed with boom gear member 131. First boom output gear 119 is arranged concentrically with first boom motor 111. First boom motor 111 transmits drive force to first boom output gear 119. Second boom output gear 129 is an external gear and it is meshed with boom gear member 131. Second boom output gear 129 is arranged concentrically with second boom motor 121. Second boom motor 121 transmits drive force to second boom output gear 129.

Figure 5:
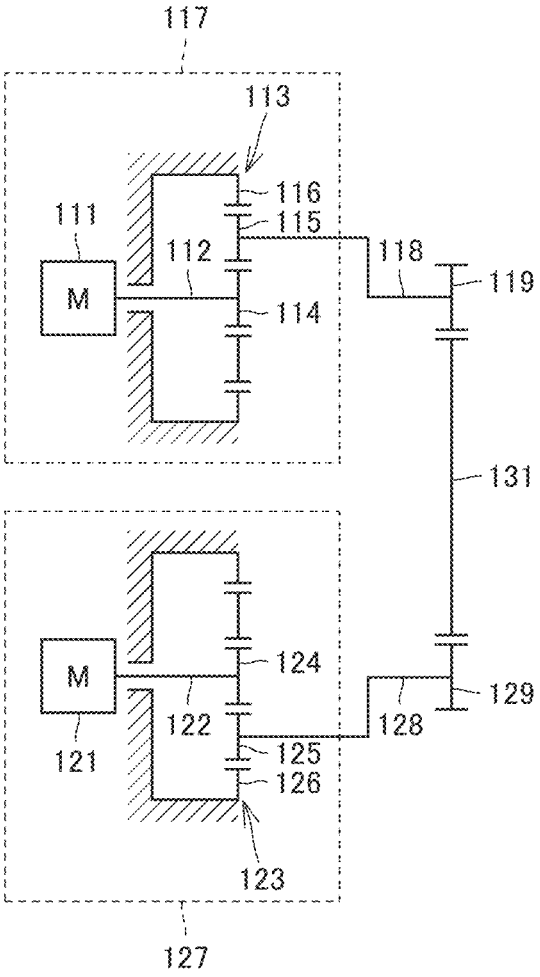
FIG. 5 is a skeleton diagram of a motive power transmission path from an electric motor to a gear member.

FIG. 5 is a skeleton diagram of a motive power transmission path from first boom motor 111 and second boom motor 121 to boom gear member 131.

In the motive power transmission path from first boom motor 111 to boom gear member 131, a planetary reduction gear 113 is provided. In the present embodiment, first boom motor 111 and planetary reduction gear 113 constitute an integrated structure. The motive power transmission apparatus that transmits drive force of first boom motor 111 to boom gear member 131 includes a geared motor 117 in which first boom motor 111 and planetary reduction gear 113 are integrated.

Planetary reduction gear 113 includes a plurality of rotational elements. The plurality of rotational elements of planetary reduction gear 113 include a sun gear 114, a planetary gear 115, and a ring gear 116. First boom motor 111 has an output shaft 112 coupled to sun gear 114. Drive force of first boom motor 111 is inputted to sun gear 114.

Planetary reduction gear 113 and first boom output gear 119 are coupled to each other by a coupling shaft 118. More specifically, coupling shaft 118 has one end coupled to a planetary carrier that supports planetary gear 115 and has the other end coupled to first boom output gear 119. The planetary carrier and first boom output gear 119 are coupled to each other with coupling shaft 118 being interposed. Coupling shaft 118 may be arranged concentrically with output shaft 112.

In the motive power transmission path from second boom motor 121 to boom gear member 131, a planetary reduction gear 123 is provided. In the present embodiment, second boom motor 121 and planetary reduction gear 123 constitute an integrated structure. The motive power transmission apparatus that transmits drive force of second boom motor 121 to boom gear member 131 includes a geared motor 127 in which second boom motor 121 and planetary reduction gear 123 are integrated.

Planetary reduction gear 123 includes a plurality of rotational elements. The plurality of rotational elements of planetary reduction gear 123 include a sun gear 124, a planetary gear 125, and a ring gear 126. Second boom motor 121 has an output shaft 122 coupled to sun gear 124. Drive force of second boom motor 121 is inputted to sun gear 124.

Planetary reduction gear 123 and second boom output gear 129 are coupled to each other by a coupling shaft 128. More specifically, coupling shaft 128 has one end coupled to a planetary carrier that supports planetary gear 125 and has the other end coupled to second boom output gear 129. The planetary carrier and second boom output gear 129 are coupled to each other with coupling shaft 128 being interposed. Coupling shaft 128 may be arranged concentrically with output shaft 122.

First boom output gear 119 is meshed with boom gear member 131. Drive force generated by first boom motor 111 is transmitted to boom gear member 131 through first boom output gear 119. Second boom output gear 129 is meshed with boom gear member 131. Drive force generated by second boom motor 121 is transmitted to boom gear member 131 through second boom output gear 129. Upon receiving transmission of drive force from first boom motor 111 and second boom motor 121, boom gear member 131 rotates as being integrated with boom 11 to which it is connected. Boom 11 is thus rotationally driven around boom foot pin 15.

Planetary reduction gear 113, coupling shaft 118, and first boom output gear 119 mechanically transmit drive force generated by first boom motor 111 to boom 11. Planetary reduction gear 123, coupling shaft 128, and second boom output gear 129 mechanically transmit drive force generated by second boom motor 121 to boom 11. Planetary reduction gears 113 and 123, coupling shafts 118 and 128, and first boom output gear 119 and second boom output gear 129 constitute a boom motive power transmission apparatus that mechanically transmits drive force generated by boom motor 110 to boom 11.

The boom motive power transmission apparatus is arranged opposite to operator's cab 4 with respect to work implement 10. In the construction in the embodiment where operator's cab 4 is arranged on the front left side on vehicular body frame 3 and operator's cab 4 is arranged on the left of work implement 10, the boom motive power transmission apparatus is arranged on the right of work implement 10.

Figure 6:
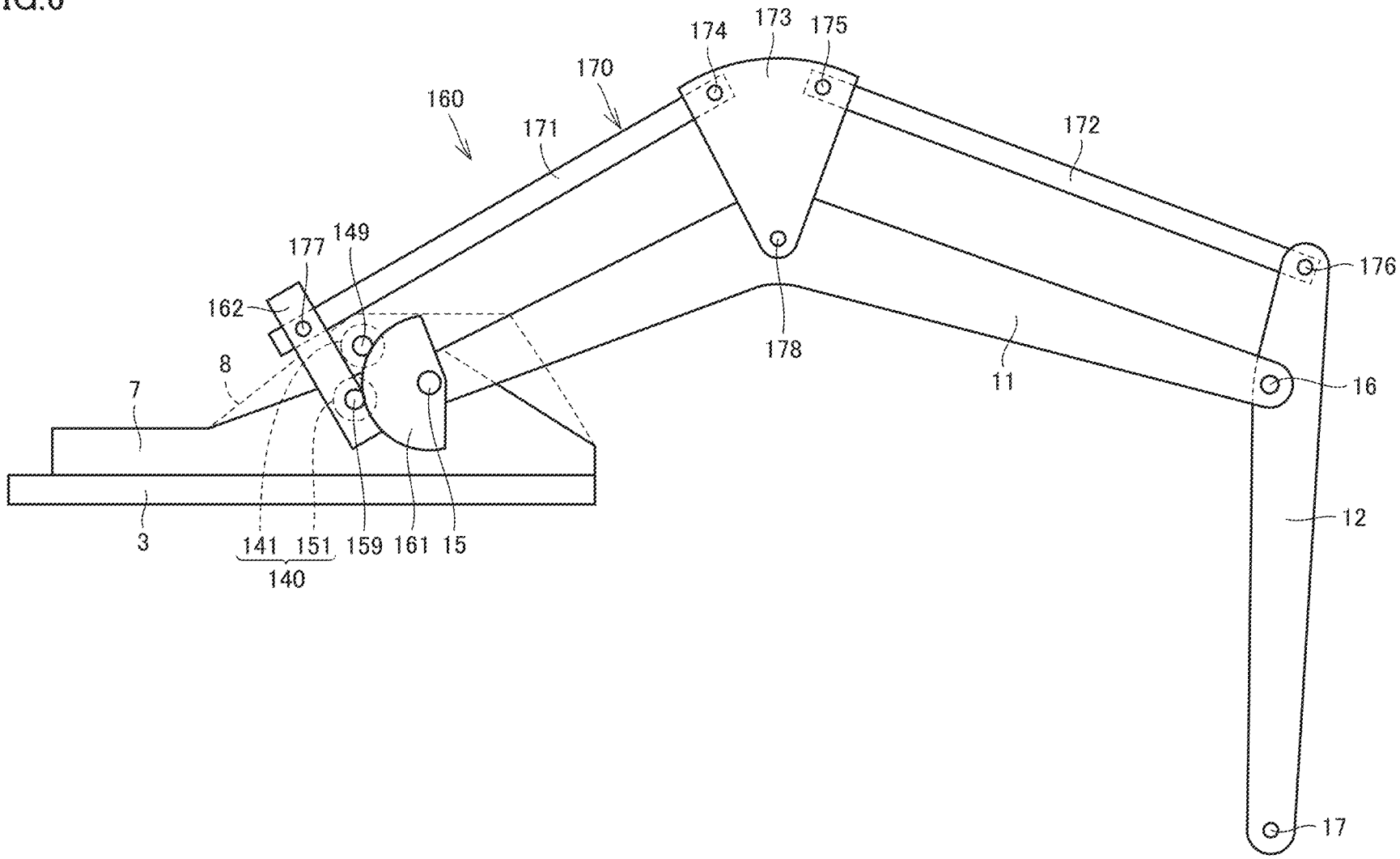
FIG. 6 is a diagram showing a general construction of a motive power transmission apparatus that transmits drive force to an arm.

FIG. 6 is a diagram showing a general construction of a motive power transmission apparatus 160 that transmits drive force to arm 12. Motive power transmission apparatus 160 that mechanically transmits drive force generated by arm motor 140 to arm 12 includes a first arm output gear 149, a second arm output gear 159, an arm gear member 161, a pivot member 162, and an arm link 170.

Arm gear member 161 is in a shape of a substantial sector and has a tooth profile in an arc portion of the substantial sector. As shown in FIGS. 2 and 3, arm gear member 161 is separate from boom gear member 131 and arranged on the right of boom gear member 131 as being distant from boom gear member 131. In the lateral direction, a gap is interposed between boom gear member 131 and arm gear member 161. Arm gear member 161 is arranged at the base end of boom 11. Arm gear member 161 carries out rotational motion relative to vehicular body frame 3 as being concentric with boom foot pin 15.

First arm output gear 149 is an external gear and it is meshed with arm gear member 161. First arm output gear 149 is arranged concentrically with first arm motor 141. First arm motor 141 transmits drive force to first arm output gear 149. Second arm output gear 159 is an external gear and it is meshed with arm gear member 161. Second arm output gear 159 is arranged concentrically with second arm motor 151. Second arm motor 151 transmits drive force to second arm output gear 159.

A motive power transmission path from first arm motor 141 and second arm motor 151 to arm gear member 161 is similar to the motive power transmission path to boom gear member 131 shown in FIG. 5. In the motive power transmission path from first arm motor 141 to arm gear member 161, a planetary reduction gear is provided. First arm motor 141 and the planetary reduction gear constitute an integrated structure. In the motive power transmission path from second arm motor 151 to arm gear member 161, a planetary reduction gear is provided. Second arm motor 151 and the planetary reduction gear constitute an integrated structure. Arm gear member 161 rotates upon receiving transmission of drive force from first arm motor 141 and second arm motor 151.

Pivot member 162 is fixed to arm gear member 161 and carries out rotational motion relative to vehicular body frame 3 as being concentric with boom foot pin 15 and being integrated with arm gear member 161. Arm gear member 161 and pivot member 162 correspond to the first transmission portion in the embodiment.

Arm link 170 includes a first link member 171, a second link member 172, and an intermediate member 173. Intermediate member 173 is connected to boom 11 with a pin 178 being interposed. Boom 11 in a side view is in a bent shape and intermediate member 173 is connected to a bent portion of boom 11.

First link member 171 is in a rod shape. First link member 171 extends along boom 11. First link member 171 is coupled to pivot member 162 at a first end thereof, with a coupling pin 177 being interposed. First link member 171 is coupled to intermediate member 173 at a second end thereof, with a coupling pin 174 being interposed. First link member 171 couples pivot member 162 and intermediate member 173 to each other. First link member 171 transmits to intermediate member 173, drive force generated by arm motor 140 and transmitted to pivot member 162 through arm gear member 161.

Second link member 172 is in a rod shape. Second link member 172 extends along boom 11. Second link member 172 is coupled to intermediate member 173 at a first end thereof, with a coupling pin 175 being interposed. Second link member 172 is coupled to arm 12 at a second end thereof, with a coupling pin 176 being interposed. Second link member 172 couples intermediate member 173 and arm 12 to each other. Second link member 172 transmits to arm 12, drive force generated by arm motor 140 and transmitted to intermediate member 173 sequentially through arm gear member 161, pivot member 162, and first link member 171.

Intermediate member 173 may be in a substantially polygonal shape. First link member 171 and second link member 172 may be coupled to intermediate member 173 in the vicinity of different vertices of the substantially polygonal shape of intermediate member 173. Intermediate member 173 may be in any shape, without being limited to the substantially polygonal shape. For example, intermediate member 173 may be in a rod shape and may have a base end connected to boom 11.

Arm link 170 (first link member 171, second link member 172, and intermediate member 173) corresponds to the second transmission portion in the embodiment that transmits motive power to arm 12 by rotational motion of the first transmission portion relative to vehicular body frame 3.

<Double-Motor Drive>

In general, in a gear mechanism, there is a backlash which refers to a gap provided between tooth flanks of meshed gears. Therefore, accuracy in positioning of a movable member coupled to a driven gear lowers. In the case of the work machine, a backlash in a gear mechanism provided at a root portion of boom 11 causes position displacement of an attachment at the tip end of work implement 10. In order to reduce the backlash, the motive power transmission apparatus in the embodiment is constructed as a double-motor drive motive power transmission apparatus in which two motors drive a single gear member.

Specifically, boom gear member 131 that transmits drive force to boom 11 is driven by first boom motor 111 and second boom motor 121. Arm gear member 161 that transmits drive force to arm 12 is driven by first arm motor 141 (first motor) and second arm motor 151 (second motor). Double-motor drive will be described below with reference to a structure in which first arm motor 141 and second arm motor 151 drive arm gear member 161 by way of example.

Figure 7:
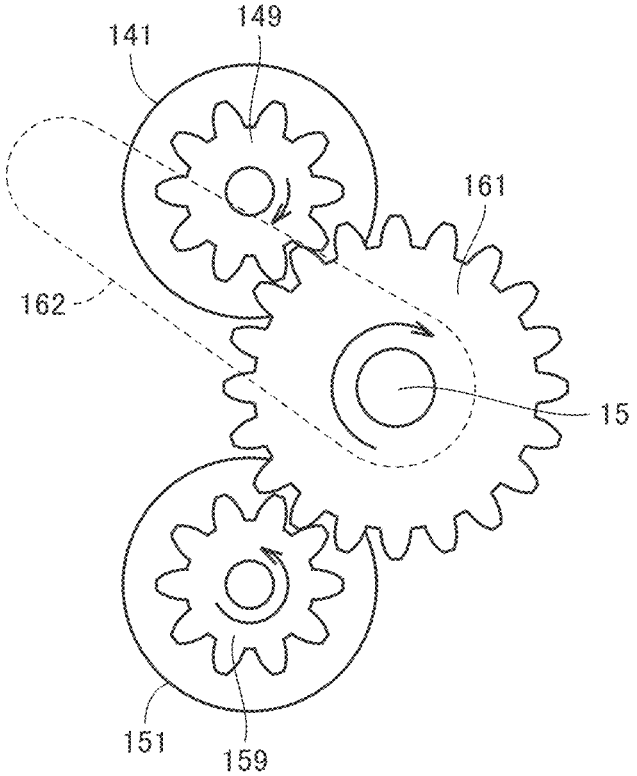
FIG. 7 is a diagram schematically showing a structure of double-motor drive.

FIG. 7 is a schematic diagram of double-motor drive. Since FIG. 7 schematically illustrates double-motor drive, the shape of arm gear member 161 and arrangement of first arm output gear 149 and second arm output gear 159 with respect to arm gear member 161 are different from those in the embodiment shown in FIG. 6.

First arm output gear 149 and second arm output gear 159 are meshed with arm gear member 161 fixed to pivot member 162. First arm output gear 149 is connected to first arm motor 141 and first arm output gear 149 rotates as first arm motor 141 is rotationally driven. Second arm output gear 159 is connected to second arm motor 151, and second arm output gear 159 rotates as second arm motor 151 is rotationally driven.

In the arrangement shown in FIG. 7, a clockwise direction of each gear is defined as a positive direction of rotation and a counterclockwise direction thereof is defined as a negative direction of rotation.

FIG. 8 is a diagram showing control in double-motor drive. Under coordinated control of first arm motor 141 and second arm motor 151, backlash elimination control to bring tooth flanks of gears into contact with each other without leaving any gap is carried out to enhance accuracy in positioning of the attachment at the tip end of work implement 10. In order to improve efficiency of the motive power transmission apparatus, backlash elimination control does not have to be carried out. By switching between execution and non-execution of backlash elimination control, one of a highly accurate position of the attachment and highly efficient motive power transmission can be selected, and regeneration with kinematic energy of work implement 10 can be achieved by adoption of a highly efficient planetary gear mechanism.

As shown in FIG. 8, in carrying out backlash elimination control, first arm motor 141 constantly applies offset torque in the positive direction having magnitude a to arm gear member 161 and second arm motor 151 constantly applies offset torque in the negative direction having magnitude a to arm gear member 161.

For stopping arm gear member 161, first arm motor 141 and second arm motor 151 apply offset torque equal in magnitude and opposite in direction to arm gear member 161. Magnitude of total of torque applied to arm gear member 161 by first arm motor 141 and torque applied to arm gear member 161 by second arm motor 151 is zero.

At this time, both of first arm output gear 149 and second arm output gear 159 sandwich arm gear member 161, in their effort to rotate in directions opposite to each other. While the tooth flank of first arm output gear 149 is in contact with the tooth flank of arm gear member 161 and the tooth flank of second arm output gear 159 is in contact with the tooth flank of arm gear member 161, arm gear member 161 is held. As both of first arm output gear 149 and second arm output gear 159 are pressed against arm gear member 161, the backlash can be suppressed.

In rotation of arm gear member 161 at a low speed in the counterclockwise direction, torque generated by first arm motor 141 is increased. First arm motor 141 applies offset torque in the positive direction having magnitude a and drive torque in the positive direction having magnitude T to first arm output gear 149. Second arm motor 151 applies offset torque in the negative direction having magnitude a to second arm output gear 159. Torque applied to first arm output gear 149 by first arm motor 141 and torque applied to second arm output gear 159 by second arm motor 151 result in total torque in the positive direction having magnitude T.

By increasing torque of first arm motor 141, arm gear member 161 is driven in the negative direction (counterclockwise direction). At this time, second arm motor 151 keeps applying offset torque in the direction opposite to the direction of rotation of arm gear member 161. First arm motor 141 drives arm gear member 161 and second arm motor 151 slightly applies brakes to arm gear member 161.

At this time, both of first arm output gear 149 and second arm output gear 159 sandwich arm gear member 161, in their effort to rotate in directions opposite to each other. The tooth flank of first arm output gear 149 comes in contact with the tooth flank of arm gear member 161 and the tooth flank of second arm output gear 159 comes in contact with the tooth flank of arm gear member 161. As both of first arm output gear 149 and second arm output gear 159 are pressed against arm gear member 161, the backlash can be suppressed.

In rotation of arm gear member 161 at the low speed in the clockwise direction, torque generated by second arm motor 151 is increased. Second arm motor 151 applies offset torque in the negative direction having magnitude a and drive torque in the negative direction having magnitude T to second arm output gear 159. First arm motor 141 applies offset torque in the positive direction having magnitude a to first arm output gear 149. Torque applied to first arm output gear 149 by first arm motor 141 and torque applied to second arm output gear 159 by second arm motor 151 result in total torque in the negative direction having magnitude T.

By increasing torque of second arm motor 151, arm gear member 161 is driven in the positive direction (clockwise direction). At this time, first arm motor 141 keeps applying offset torque in the direction opposite to the direction of rotation of arm gear member 161. Second arm motor 151 drives arm gear member 161 and first arm motor 141 slightly applies brakes to arm gear member 161.

At this time, both of first arm output gear 149 and second arm output gear 159 sandwich arm gear member 161, in their effort to rotate in directions opposite to each other. The tooth flank of first arm output gear 149 comes in contact with the tooth flank of arm gear member 161 and the tooth flank of second arm output gear 159 comes in contact with the tooth flank of arm gear member 161. As both of first arm output gear 149 and second arm output gear 159 are pressed against arm gear member 161, the backlash can be suppressed.

By carrying out backlash elimination control, accuracy in positioning of the attachment at the tip end of work implement 10 can be enhanced and highly accurate works using the attachment can be done. Motive power transmission efficiency while arm gear member 161 is at a standstill is zero. When magnitude a of offset torque is assumed as 0.25 time as large as magnitude T of drive torque and efficiency of the gear is assumed as 100%, motive power transmission efficiency in rotation of arm gear member 161 at a low speed is calculated as 66%.

As shown in FIG. 8, in not carrying out backlash elimination control, first arm motor 141 and second arm motor 151 do not apply offset torque to arm gear member 161. Since arm gear member 161 is rotated at a high speed, first arm motor 141 and second arm motor 151 apply drive torque in the same direction to arm gear member 161.

In rotation of arm gear member 161 at the high speed in the counterclockwise direction, first arm motor 141 applies drive torque in the positive direction having magnitude T to first arm output gear 149. Second arm motor 151 applies drive torque in the positive direction having magnitude T to second arm output gear 159. Torque applied to first arm output gear 149 by first arm motor 141 and torque applied to second arm output gear 159 by second arm motor 151 result in total torque in the positive direction having magnitude 2T.

In rotation of arm gear member 161 at the high speed in the clockwise direction, first arm motor 141 applies drive torque in the negative direction having magnitude T to first arm output gear 149. Second arm motor 151 applies drive torque in the negative direction having magnitude T to second arm output gear 159. Torque applied to first arm output gear 149 by first arm motor 141 and torque applied to second arm output gear 159 by second arm motor 151 result in total torque in the negative direction having magnitude 2T.

Both of first arm motor 141 and second arm motor 151 apply drive torque to arm gear member 161. Neither of first arm motor 141 and second arm motor 151 apply brakes to arm gear member 161. When efficiency of a gear is assumed as 100%, motive power transmission efficiency in rotation of arm gear member 161 at a high speed is 100%. As backlash elimination control is not carried out, motive power can highly efficiently be transmitted to arm gear member 161. Though accuracy in positioning of the attachment at the tip end of work implement 10 becomes low, it does not give rise to a problem because high positioning accuracy is not required for the attachment that is moving at a high speed.

The motive power transmission path from first arm motor 141 to first arm output gear 149 includes a highly efficient planetary reduction gear. The motive power transmission path from second arm motor 151 to second arm output gear 159 includes a highly efficient planetary reduction gear. When great external force is applied to the attachment at the tip end of work implement 10 due to collision of the attachment against an object while backlash elimination control is not being carried out, that external force is allowed to pass through the planetary reduction gear and conduct to first arm motor 141 and second arm motor 151.

A rotor portion of each of first arm motor 141 and second arm motor 151 does not include a contacting component other than a bearing that rotatably supports the rotor portion. Therefore, when great external force is applied, angular displacement occurs in the rotor portion. As first arm motor 141 and second arm motor 151 step out, the planetary reduction gear can consequently be prevented from being broken.

While backlash elimination control is being carried out, the attachment at the tip end of work implement 10 is at a standstill or moves at a low speed if it moves. Since a moving speed of the attachment at the tip end of work implement 10 is low and impact at the time of collision of the attachment against an object is small, the planetary reduction gear is prevented from being broken.

Figure 9:
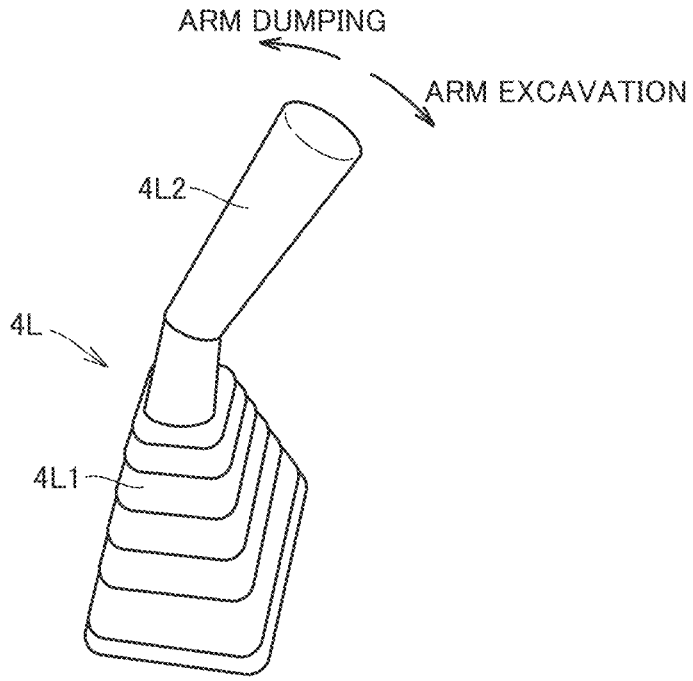
FIG. 9 is a perspective view of a control lever.

A direction of rotation of first arm motor 141 and second arm motor 151 and drive force generated thereby are adjusted in accordance with an operation by an operator to operate work implement 10. FIG. 9 is a perspective view of a control lever 4L. Control lever 4L represents an exemplary operation apparatus operated by the operator to operate work implement 10. Control lever 4L is, for example, an electric lever.

Control lever 4L is arranged, for example, in operator's cab 4 (FIG. 1). Control lever 4L is arranged, for example, on the left of operator's seat 4S (FIG. 1). Control lever 4L includes a root portion 4L1 attached to operator's cab 4 and a grip portion 4L2 that protrudes upward from root portion 4L1 and is movable relatively to root portion 4L1. As the operator who is seated at operator's seat 4S holds grip portion 4L2 with his/her left hand and operates control lever 4L, the operator can operate arm 12.

By moving control lever 4L to the left by way of example, the operator can move arm 12 in a direction of dumping (a direction in which arm 12 is moved away from boom 11). By moving control lever 4L to the right, the operator can move arm 12 in a direction of excavation (a direction in which arm 12 comes closer to boom 11).

A direction of operation and an amount of operation onto control lever 4L are detected by a sensor such as a potentiometer or a hall IC. Based on this detection value, a control device that controls the operation of arm 12 in accordance with the operation by the operator generates a control signal for controlling first arm motor 141 and second arm motor 151 and transmits the control signal to first arm motor 141 and second arm motor 151.

Figure 10:
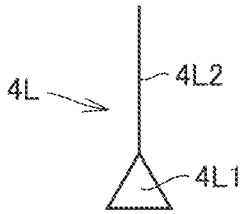
FIG. 10 is a schematic diagram showing the control lever while the gear member is at a standstill.

FIG. 10 is a schematic diagram showing control lever 4L while arm gear member 161 is at a standstill. FIG. 10 schematically shows control lever 4L while the operator is not touching control lever 4L. As shown in FIG. 9, grip portion 4L2 of control lever 4L is actually inclined toward operator's seat 4S. In FIG. 10 and FIGS. 11 to 14 which will be described later, however, while the operator is not touching control lever 4L, grip portion 4L2 is assumed to extend straight upward in the drawing from root portion 4L1. A position of grip portion 4L2 relative to root portion 4L1 shown in FIG. 10 is referred to as a neutral position in the description with reference to FIGS. 11 to 14.

Figure 11:
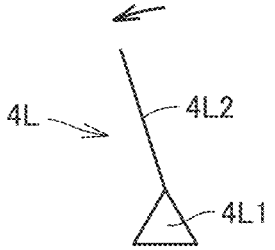
FIG. 11 is a schematic diagram showing the control lever while the gear member rotates counterclockwise at a low speed.

FIG. 11 is a schematic diagram showing control lever 4L while arm gear member 161 rotates counterclockwise at a low speed. Grip portion 4L2 of control lever 4L shown in FIG. 11 is inclined to the left from the neutral position. In accordance with this operation onto control lever 4L, first arm motor 141 generates offset torque in the positive direction having magnitude a and drive torque in the positive direction having magnitude T, and second arm motor 151 generates offset torque in the negative direction having magnitude a. As arm gear member 161 rotates counterclockwise at the low speed, force in a direction of pull toward the base end coupled to pivot member 162 is applied to arm link 170. Arm 12 thus moves in the direction of dumping at the low speed.

Figure 12:
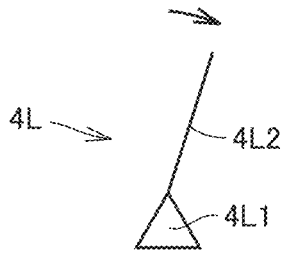
FIG. 12 is a schematic diagram showing the control lever while the gear member rotates clockwise at a low speed.

FIG. 12 is a schematic diagram showing control lever 4L while arm gear member 161 rotates clockwise at a low speed. Grip portion 4L2 of control lever 4L shown in FIG. 12 is inclined to the right from the neutral position. In accordance with this operation onto control lever 4L, first arm motor 141 generates offset torque in the positive direction having magnitude a and second arm motor 151 generates offset torque in the negative direction having magnitude a and drive torque in the negative direction having magnitude T. As arm gear member 161 rotates clockwise at the low speed, force in a direction of push from the base end coupled to pivot member 162 toward the tip end coupled to arm 12 is applied to arm link 170. Arm 12 thus moves in the direction of excavation at the low speed.

Figure 13:
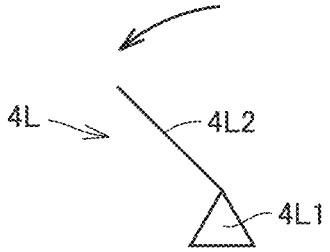
FIG. 13 is a schematic diagram showing the control lever while the gear member rotates counterclockwise at a high speed.

FIG. 13 is a schematic diagram showing control lever 4L while arm gear member 161 rotates counterclockwise at a high speed. Grip portion 4L2 of control lever 4L shown in FIG. 13 is greatly inclined to the left from the neutral position. In accordance with this operation onto control lever 4L, first arm motor 141 generates drive torque in the positive direction having magnitude T, and second arm motor 151 generates drive torque in the positive direction having magnitude T. As arm gear member 161 rotates counterclockwise at the high speed, force in the direction of pull toward the base end coupled to pivot member 162 is applied to arm link 170. Arm 12 thus moves in the direction of dumping at the high speed.

Figure 14:
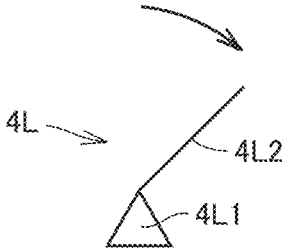
FIG. 14 is a schematic diagram showing the control lever while the gear member rotates clockwise at a high speed.

FIG. 14 is a schematic diagram showing control lever 4L while arm gear member 161 rotates clockwise at a high speed. Grip portion 4L2 of control lever 4L shown in FIG. 14 is greatly inclined to the right from the neutral position. In accordance with this operation onto control lever 4L, first arm motor 141 generates drive torque in the negative direction having magnitude T, and second arm motor 151 generates drive torque in the negative direction having magnitude T. As arm gear member 161 rotates clockwise at the high speed, force in the direction of push from the base end coupled to pivot member 162 toward the tip end coupled to arm 12 is applied to arm link 170. Arm 12 thus moves in the direction of excavation at the high speed.

The direction of rotation of first arm motor 141 and second arm motor 151 and drive force generated thereby can thus be adjusted in accordance with the operation onto control lever 4L. Therefore, the attachment at the tip end of work implement 10 can be moved highly efficiently at a high speed, moved at a slow speed with high position accuracy, or come to rest with high position accuracy in accordance with the operator's intention.

<Motor Parallel Arrangement>

Figure 15:
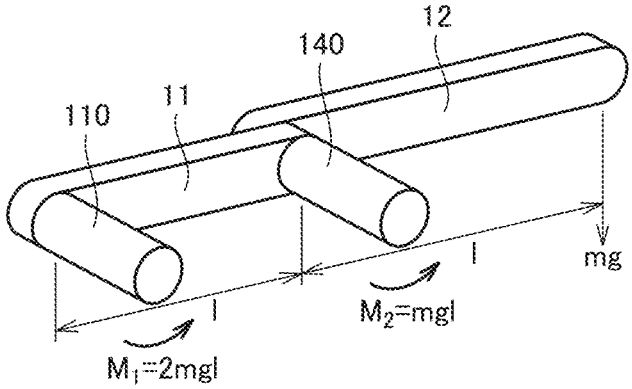
FIG. 15 is a schematic diagram of motor serial arrangement.
Figure 16:
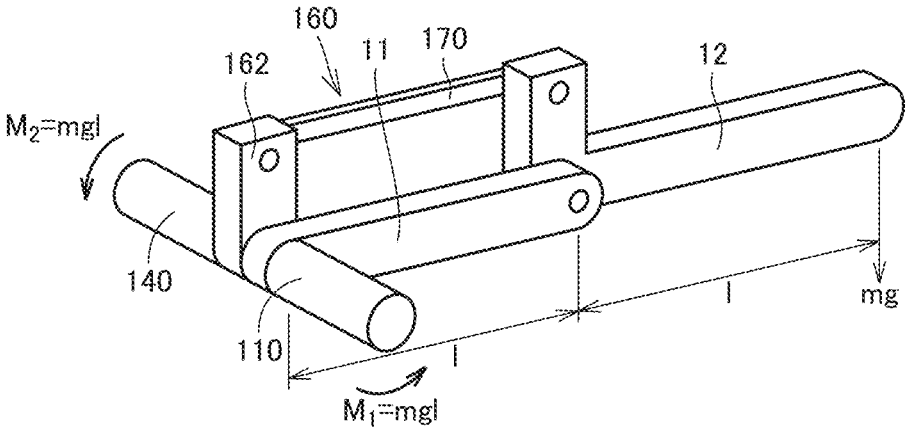
FIG. 16 is a schematic diagram of motor parallel arrangement.

FIG. 15 is a schematic diagram of motor serial arrangement. FIG. 15 and FIG. 16 which will be described later schematically show boom 11 and arm 12 and schematically show arrangement of boom motor 110 and arm motor 140 with respect to boom 11 and arm 12.

Boom motor 110 that drives boom 11 shown in FIG. 15 is arranged at the base end of boom 11. Arm motor 140 that drives arm 12 is arranged at the base end of arm 12. Arm motor 140 is arranged at a position of arm coupling pin 16 (FIG. 1 or the like) that couples boom 11 and arm 12 to each other. Arrangement of boom motor 110 and arm motor 140 with respect to work implement 10 shown in FIG. 15 is referred to as motor serial arrangement.

Boom 11 is assumed to have a length 1 and arm 12 is assumed to have a length 1. At this time, boom motor 110 should generate moment M1 of magnitude 2 mgl for supporting boom 11 and arm 12 against external force of magnitude mg applied to the tip end of arm 12, and arm motor 140 should generate moment M2 of magnitude mgl for supporting arm 12 against the same.

In the case of motor serial arrangement, in order to drive boom 11 and arm 12, a large motor (boom motor 110) that generates moment of magnitude 2 mgl and a small motor (arm motor 140) that generates moment of magnitude mgl are required. Since arm motor 140 and a reduction gear should be supported by boom motor 110, output from boom motor 110 becomes great. Since arm motor 140 is arranged at the base end of arm 12 close to the tip end of arm 12 which is a point of input of external force, impact transmitted to arm motor 140 becomes great.

FIG. 16 is a schematic diagram of motor parallel arrangement. Boom motor 110 that drives boom 11 shown in FIG. 16 is arranged at the base end of boom 11. Arm motor 140 that drives arm 12 is also arranged at the base end of boom 11. Arm motor 140 and arm 12 are coupled to each other by motive power transmission apparatus 160 including pivot member 162 and arm link 170. Arm motor 140 transmits drive force to the base end of arm 12 through motive power transmission apparatus 160. Arrangement of boom motor 110 and arm motor 140 with respect to work implement 10 shown in FIG. 16 is referred to as motor parallel arrangement.

Boom 11 is assumed to have length 1 and arm 12 is assumed to have length 1. At this time, external force of magnitude mg applied to the tip end of arm 12 is allocated to boom motor 110 and arm motor 140. Boom motor 110 should generate moment M1 of magnitude mgl for driving boom 11 and moment M2 of magnitude mgl for driving arm 12.

In the present embodiment, since both of boom motor 110 and arm motor 140 are mounted on vehicular body frame 3, motor parallel arrangement is adopted. In the case of motor parallel arrangement, two small motors (boom motor 110 and arm motor 140) that generate moment of magnitude mgl suffice for driving boom 11 and arm 12. Total of drive torque generated by boom motor 110 and arm motor 140 is smaller and a motor smaller in rated output can be adopted. Therefore, reduction in size and reduction in cost of the motor are achieved.

Boom motor 110 does not have to support arm motor 140 and the reduction gear, so that power saving can be achieved. Since both of boom motor 110 and arm motor 140 are arranged at a position distant from the tip end of arm 12 which is the point of input of external force, boom motor 110 and arm motor 140 are less likely to be affected by impact and impact resistance can be improved.

Figure 17:
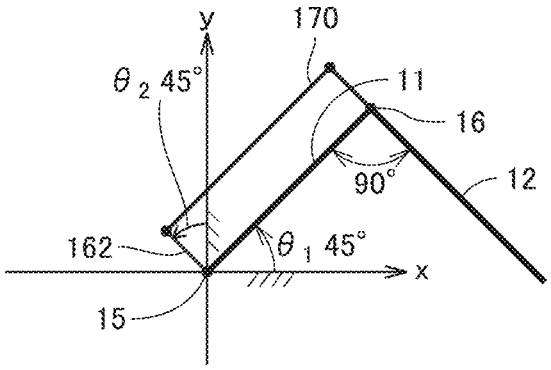
FIG. 17 is a simplified diagram of the work implement.

Drive of work implement 10 with motor parallel arrangement will be described. FIG. 17 is a simplified diagram of work implement 10. FIG. 17 and FIGS. 18 to 20 which will be described later show boom 11, arm 12, pivot member 162, and arm link 170 with a straight line in a simplified manner. As described with reference to FIGS. 2 and 6, arm link 170 in the embodiment actually includes first link member 171 and second link member 172, and directions of extension of first link member 171 and second link member 172 intersect with each other along the bent shape of boom 11. In FIGS. 17 to 20, however, arm link 170 is assumed to linearly extend.

In an xy plane shown in FIGS. 17 to 20, work implement 10 is arranged such that boom foot pin 15 is located at the origin. An x axis passes through boom foot pin 15 and extends horizontally. A fore direction of electric excavator 30 (the fore direction of vehicular body frame 3) corresponds to a +x direction. An upward direction in electric excavator 30 corresponds to a +y direction.

A boom angle θ1 shown in FIG. 17 is an angle formed between the direction of extension of boom 11 and the +x direction and it is 45° in FIG. 17. An arm drive link angle θ2 is an angle formed between the direction of extension of pivot member 162 and the +y direction and it is 45° in FIG. 17. In FIG. 17, an angle formed between boom 11 and arm 12 is 90°. A posture of work implement 10 shown in FIG. 17 is referred to as a basic posture in the description with reference to FIGS. 18 to 20.

Figure 18:
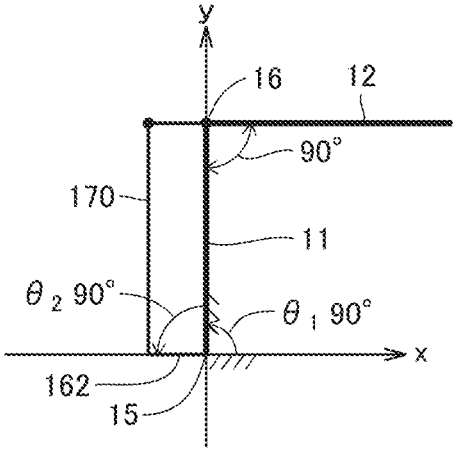
FIG. 18 is a simplified diagram of a state in which the boom is moved relatively to the vehicular body frame.

FIG. 18 is a simplified diagram of a state in which boom 11 is moved relatively to vehicular body frame 3. In FIG. 18, boom angle θ1 is 90° which is larger than that in the basic posture, arm drive link angle θ2 is 90° which is larger than that in the basic posture, and the angle formed between boom 11 and arm 12 is 90° which is the same as that in the basic posture. Work implement 10 shown in FIG. 18 takes a posture with boom 11 being raised from the basic posture, with the position of arm 12 relative to boom 11 being maintained.

When work implement 10 is moved from the basic posture to the posture shown in FIG. 18, boom 11 is moved relatively to vehicular body frame 3. In order to maintain the position of arm 12 relative to boom 11, arm 12 is moved relatively to vehicular body frame 3. Therefore, both of boom motor 110 and arm motor 140 should generate drive torque. As boom motor 110 and arm motor 140 individually generate drive torque in a shared manner, work implement 10 can be moved from the basic posture to the posture shown in FIG. 18.

Figure 19:
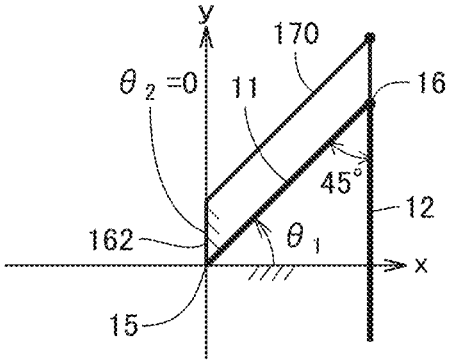
FIG. 19 is a simplified diagram of a state in which the arm is moved relatively to the boom.

FIG. 19 is a simplified diagram of a state in which arm 12 is moved relatively to boom 11. In FIG. 19, boom angle θ1 is 45° which is the same as that in the basic posture, arm drive link angle θ2 is 0° which is smaller than that in the basic posture, and the angle formed between boom 11 and arm 12 is 45° which is smaller than that in the basic posture. Work implement 10 shown in FIG. 19 takes such a posture that arm 12 is moved in the direction of excavation as compared with the basic posture while boom 11 remains at rest.

When work implement 10 is moved from the basic posture to the posture shown in FIG. 19, arm 12 is moved relatively to vehicular body frame 3. Therefore, boom motor 110 is driven only for generating offset torque and arm motor 140 generates drive torque. Thus, arm 12 alone can be moved while boom 11 remains at rest to move work implement 10 from the basic posture to the posture shown in FIG. 19.

Figure 20:
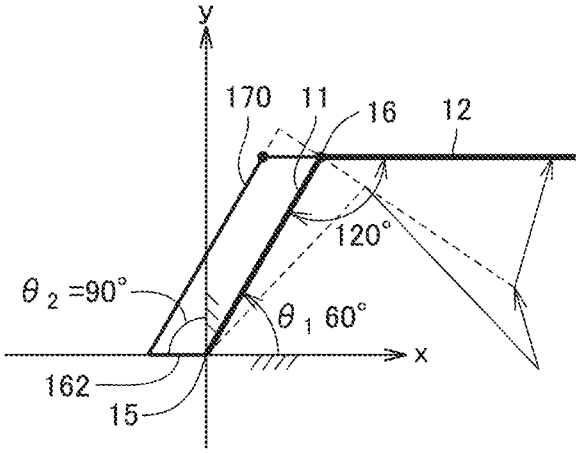
FIG. 20 is a simplified diagram of a state in which the boom is moved relatively to the vehicular body frame and the arm is moved relatively to the boom.

FIG. 20 is a simplified diagram of a state in which boom 11 is moved relatively to vehicular body frame 3 and arm 12 is moved relatively to boom 11. In FIG. 20, boom angle θ1 is 60° which is larger than that in the basic posture, arm drive link angle θ2 is 90° which is larger than that in the basic posture, and the angle formed between boom 11 and arm 12 is 120° which is larger than that in the basic posture. The work implement shown in FIG. 20 takes such a posture that boom 11 is moved upward and arm 12 is moved in the direction of dumping as compared with the basic posture.

When work implement 10 is moved from the basic posture to the posture shown in FIG. 20, boom 11 is moved relatively to vehicular body frame 3 and arm 12 is moved relatively to vehicular body frame 3. Therefore, both of boom motor 110 and arm motor 140 should generate drive torque. As boom motor 110 and arm motor 140 individually generate drive torque in a shared manner, work implement 10 can be moved from the basic posture to the posture shown in FIG. 20.

Functions and Effects

Characteristic features and functions and effects of the present embodiment will be summarized as below, although some description may overlap with the description above.

As shown in FIGS. 2 and 6, electric excavator 30 includes arm motor 140 that generates drive force for moving arm 12 relatively to boom 11. As arm 12 is electrically driven without being driven by a hydraulic cylinder and the operation by arm 12 is electrically powered, motive power can be reduced and a more environment-friendly work machine can be realized. Since the hydraulic cylinder is not used, influence by variation in hydraulic pressure can be lessened, influence by variation in kinematic viscosity characteristics due to variation in temperature of hydraulic oil can be lessened, and noise generated during works can be lowered.

As shown in FIGS. 2 and 6, arm motor 140 is mounted on vehicular body frame 3. Arm motor 140 that drives arm 12 at the tip end of boom 11 is not mounted on boom 11 but on vehicular body frame 3. As a heavy object is not mounted on work implement 10, work implement 10 can be lighter in weight. As the heavy object is mounted on vehicular body frame 3, stability of electric excavator 30 can be increased.

By arranging arm motor 140 at the position distant from bucket 13 on which loads are imposed during works, impact transmitted to arm motor 140 can be lessened and hence reliability of arm motor 140 can be improved. In works for dredging rivers and harbors, bucket 13 and arm 12 move into water. Submergence of arm motor 140 mounted on vehicular body frame 3, however, does not have to be taken into consideration and arm motor 140 can be simplified in construction.

As shown in FIGS. 2 and 6, electric excavator 30 includes motive power transmission apparatus 160. Motive power transmission apparatus 160 mechanically transmits drive force generated by arm motor 140 to arm 12. As drive force of arm motor 140 is mechanically transmitted to arm 12 without being converted to a hydraulic pressure, an amount of power consumption by arm motor 140 can be reduced. Since a capacity of a battery mounted on vehicular body frame 3 can be reduced, space efficiency of vehicular body frame 3 can be improved. Cost for manufacturing and maintenance of electric excavator 30 can be reduced in conformity with reduction of the battery.

As shown in FIG. 6, motive power transmission apparatus 160 includes arm gear member 161 and pivot member 162. Arm gear member 161 and pivot member 162 carry out rotational motion relative to vehicular body frame 3. The center of relative rotation of arm gear member 161 and pivot member 162 is concentric with boom foot pin 15. Since the center of rotation of boom 11 is identical to the center of rotation of arm gear member 161 and pivot member 162, interference of boom 11 with arm gear member 161 and pivot member 162 when they rotate relative to vehicular body frame 3 is suppressed.

As shown in FIG. 6, motive power transmission apparatus 160 includes arm link 170. Arm link 170 is coupled to pivot member 162 and coupled to arm 12. Rotational motion of arm gear member 161 and pivot member 162 relative to vehicular body frame 3 is transmitted to arm link 170 and transmitted to arm 12 through arm link 170. Drive force generated by arm motor 140 can thus reliably be transmitted to arm 12 through arm link 170.

As shown in FIG. 6, arm link 170 includes intermediate member 173 connected to boom 11 and first link member 171 and second link member 172 coupled to intermediate member 173. As boom 11 supports arm link 170, strength of arm link 170 can be improved. As arm link 170 is constructed to include two link members separately from each other, the link members can be arranged along boom 11 in the bent shape. Since a length of buckling of the rod-shaped link member can be shorter, buckling of the link member can be suppressed. Rigidity of the link member does not have to be increased for prevention of buckling and a link member smaller in diameter can be employed. Therefore, work implement 10 can be lighter in weight.

As shown in FIG. 5, electric excavator 30 includes the planetary reduction gear that decelerates rotation of the motor to increase drive force and outputs increased drive force. With the highly efficient planetary reduction gear, drive torque generated by the motor can efficiently be transmitted to work implement 10. By adopting the highly efficient planetary reduction gear to allow external force to directly conduct to the motor at the time of application of external force to the attachment at the tip end of work implement 10, break of the planetary reduction gear can be suppressed and a structure strong against impact can be obtained.

As shown in FIG. 5, as the motor and the planetary reduction gear constitute the integrated structure, reduction in size can be achieved. By adopting a commercially available geared motor, manufacturing cost can be reduced.

As shown in FIG. 6, arm gear member 161 is rotatable around boom foot pin 15. First arm output gear 149 and second arm output gear 159 are meshed with arm gear member 161. First arm motor 141 transmits drive force to first arm output gear 149. Second arm motor 151 transmits drive force to second arm output gear 159. With double-motor drive to drive a single gear member with two motors, backlash elimination control can be carried out to enhance accuracy in positioning of the attachment at the tip end of work implement 10.

As first arm motor 141 and second arm motor 151 that implement double-motor drive are identical to each other in specification, first arm motor 141 and second arm motor 151 can be controlled in coordination in a more simplified manner.

As shown in FIGS. 8 to 14, the direction of rotation of first arm motor 141 and second arm motor 151 and drive force generated thereby can be adjusted in accordance with an operation onto control lever 4L. By appropriately controlling first arm motor 141 and second arm motor 151 in accordance with the operator's intention to operate work implement 10 or typically arm 12, accuracy in positioning while arm 12 is at rest and arm 12 is moving at a low speed can be improved and efficiency in transmission of motive power while arm 12 is moving at a high speed can be improved.

As shown in FIGS. 2 and 4, electric excavator 30 includes boom motor 110 that generates drive force to move boom 11 relatively to vehicular body frame 3. As boom 11 is electrically driven without being driven by a hydraulic cylinder and the operation by boom 11 is electrically powered, motive power can be reduced and a more environment-friendly work machine can be realized. Since the hydraulic cylinder is not used, influence by variation in hydraulic pressure can be lessened, influence by variation in kinematic viscosity characteristics due to variation in temperature of hydraulic oil can be lessened, and noise generated during works can be lowered.

As shown in FIG. 4, boom gear member 131 is rotatable around boom foot pin 15. First boom output gear 119 and second boom output gear 129 are meshed with boom gear member 131. First boom motor 111 transmits drive force to first boom output gear 119. Second boom motor 121 transmits drive force to second boom output gear 129. With double-motor drive to drive a single gear member with two motors, backlash elimination control can be carried out to enhance accuracy in positioning of the attachment at the tip end of work implement 10.

As shown in FIGS. 2 and 3, boom gear member 131 is fixed to the side surface of boom 11. Thus, by applying drive force to boom gear member 131, boom 11 can reliably rotate around boom foot pin 15.

In the description of the embodiment so far, an example in which both of boom 11 and arm 12 are adapted to double-motor drive where first boom motor 111 and second boom motor 121 drive boom gear member 131 and first arm motor 141 and second arm motor 151 drive arm gear member 161 is described. When accuracy in positioning of the attachment at the tip end of work implement 10 is not required, one or both of boom gear member 131 and arm gear member 161 can be driven with single-motor drive which refers to drive by a single motor.

An example in which motive power transmission apparatus 160 includes a rod-shaped link member is described in the embodiment above. So long as motive power transmission apparatus 160 is able to mechanically transmit drive force from arm motor 140 to arm 12, however, it may include a mechanism other than the link member. For example, motive power transmission apparatus 160 may include one of a cable, a chain, a pulley, and a rack and pinion, or a combination thereof.

In the embodiment, an example in which operator's cab 4 is arranged on the front left side of vehicular body frame 3, work implement 10 is arranged on the right of operator's cab 4, and electric motor 100 is arranged on the right of work implement 10 is described. Without being limited to this arrangement, for example, by arranging operator's cab 4 in the rear of work implement 10, electric motor 100 can be arranged on both of the left and right sides of work implement 10, and hence a degree of freedom in arrangement of electric motor 100 can be improved.

In the embodiment, an example in which electric motor 100 individually includes boom motor 110 and arm motor 140 is described. Electric motors 100 that generate drive force for boom 11 and arm 12 do not necessarily have to separately be provided. Motive power may be distributed from an output shaft of a single electric motor 100 to transmit drive force to each of boom 11 and arm 12. In this case, switching of transmission of drive force to boom 11 and arm 12 may be made by an operation by the operator who gets on operator's cab 4.

Second Embodiment

Electric excavator 30 based on a second embodiment is the same in overall construction as the electric excavator in the first embodiment described with reference to FIG. 1. Electric excavator 30 includes vehicular body frame 3. Electric excavator 30 includes work implement 10. Work implement 10 includes boom 11 supported by vehicular body frame 3 and bucket 13 movable relatively to boom 11.

Figure 21:
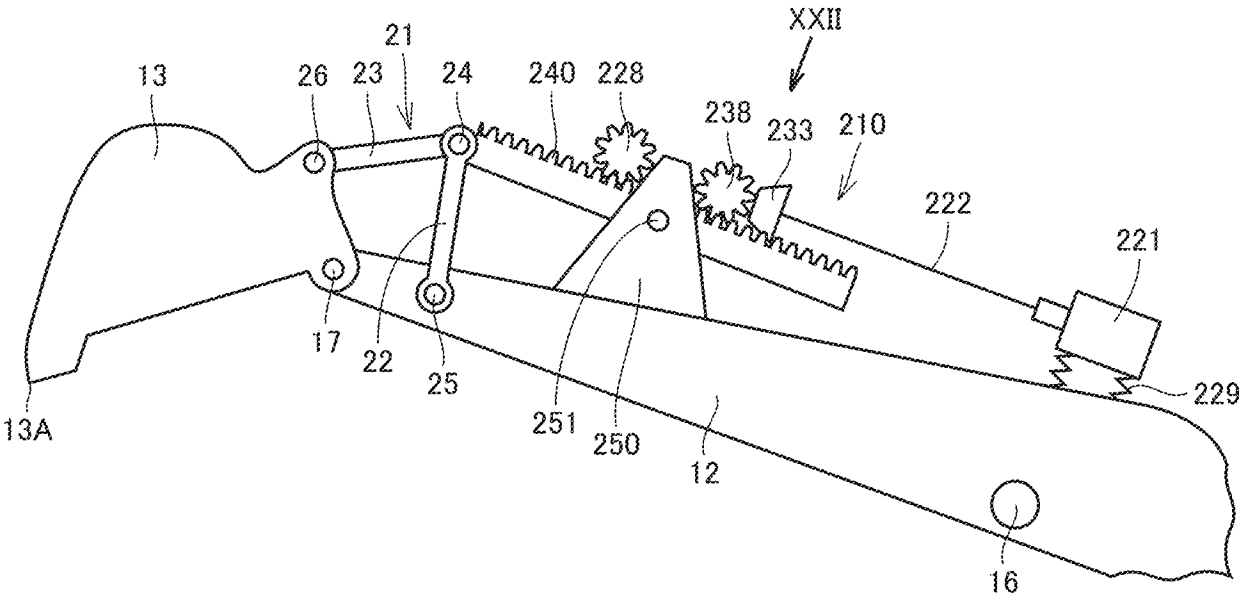
FIG. 21 is a diagram showing a general construction of a motive power transmission apparatus that transmits drive force to a bucket based on a second embodiment.
Figure 22:
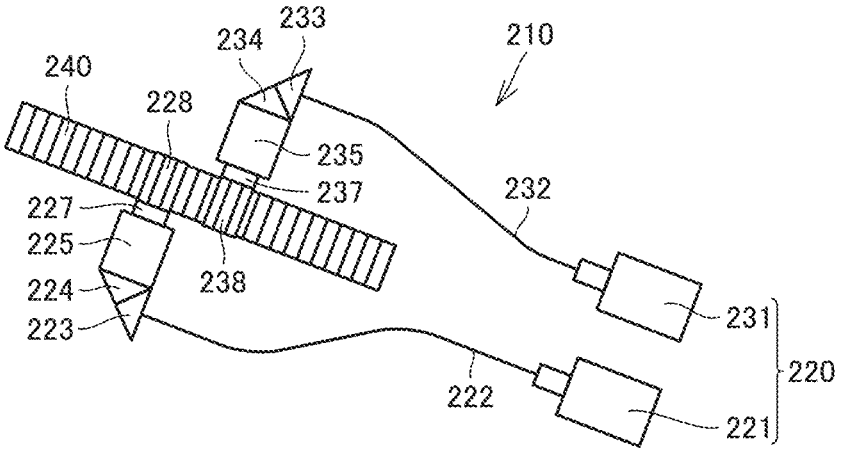
FIG. 22 is a schematic diagram of a motive power transmission apparatus viewed in a direction shown with an arrow XXII in FIG. 21.

FIG. 21 is a diagram showing a general construction of a motive power transmission apparatus 210 that transmits drive force to bucket 13 based on the second embodiment. FIG. 22 is a schematic diagram of motive power transmission apparatus 210 viewed in a direction shown with an arrow XXII in FIG. 21. Electric excavator 30 in the second embodiment is characterized in construction of motive power transmission apparatus 210.

As shown in FIGS. 21 and 22, in electric excavator 30 in the second embodiment, an attachment motor 220 generates drive force to drive bucket 13. Attachment motor 220 can drive bucket 13. As bucket 13 is driven by attachment motor 220, bucket 13 can operate. Being driven by attachment motor 220, bucket 13 is rotatable relatively to arm 12 around attachment coupling pin 17. Motive power transmission apparatus 210 mechanically transmits drive force generated by attachment motor 220 to bucket 13.

Attachment motor 220 is mounted on arm 12. A buffer mechanism 229 is attached to arm 12. Buffer mechanism 229 performs a function to buffer loads inputted to arm 12. Attachment motor 220 is mounted on arm 12 with buffer mechanism 229 being interposed. Attachment motor 220 includes a pair of a first motor 221 and a second motor 231. First motor 221 and second motor 231 are identical to each other in specification. First motor 221 and second motor 231 are identical to each other in rated output.

First motor 221 has an output shaft coupled to a flexible shaft 222. Flexible shaft 222 has a base end coupled to first motor 221. Flexible shaft 222 has a tip end coupled to a bevel gear 223. Bevel gear 223 is meshed with a bevel gear 224. Bevel gear 224 is coupled to a planetary reduction gear 225.

Planetary reduction gear 225 includes a plurality of rotational elements. The plurality of rotational elements of planetary reduction gear 225 include a sun gear, a planetary gear, and a ring gear. Bevel gear 224 is coupled to the sun gear of planetary reduction gear 225. Drive force from first motor 221 is inputted to the sun gear of planetary reduction gear 225 through flexible shaft 222 and bevel gears 223 and 224.

Planetary reduction gear 225 decelerates rotation of first motor 221 to increase drive force and outputs increased drive force. Planetary reduction gear 225 has a planetary carrier coupled to an output shaft 227. Output shaft 227 has one end coupled to the planetary carrier and has the other end coupled to a pinion 228. Pinion 228 is meshed with a rack 240.

Second motor 231 has an output shaft coupled to a flexible shaft 232. Flexible shaft 232 has a base end coupled to second motor 231. Flexible shaft 232 has a tip end coupled to a bevel gear 233. Bevel gear 233 is meshed with a bevel gear 234. Bevel gear 234 is coupled to a planetary reduction gear 235.

Planetary reduction gear 235 includes a plurality of rotational elements. The plurality of rotational elements of planetary reduction gear 235 include a sun gear, a planetary gear, and a ring gear. Bevel gear 234 is coupled to the sun gear of planetary reduction gear 235. Drive force from second motor 231 is inputted to the sun gear of planetary reduction gear 235 through flexible shaft 232 and bevel gears 233 and 234.

Planetary reduction gear 235 decelerates rotation of second motor 231 to increase drive force and outputs increased drive force. Planetary reduction gear 235 has a planetary carrier coupled to an output shaft 237. Output shaft 237 has one end coupled to the planetary carrier and the other end coupled to a pinion 238. Pinion 238 is meshed with rack 240.

Pinions 228 and 238 and rack 240 are supported by a support member 250 with a pin 251 being interposed. Support member 250 is fixed to arm 12. Rack 240 and pinions 228 and 238 are supported by arm 12 with support member 250 being interposed.

Rack 240 is coupled to link pin 24 that couples first member 22 and second member 23 of bucket link 21. Rack 240 is coupled to bucket 13 with bucket link 21 being interposed.

Drive force generated by first motor 221 is transmitted to pinion 228 to rotate pinion 228. Drive force generated by second motor 231 is transmitted to pinion 238 to rotate pinion 238. Rack 240 moves in a longitudinal direction as pinions 228 and 238 rotate.

As rack 240 moves in a direction away from arm coupling pin 16 that couples boom 11 and arm 12 to each other and toward attachment coupling pin 17 that couples arm 12 and bucket 13 to each other, bucket 13 is rotationally driven around attachment coupling pin 17. Bucket 13 moves in the direction of excavation (the direction to bring cutting edge 13A of bucket 13 toward arm 12; in FIG. 21, counterclockwise around attachment coupling pin 17).

As rack 240 moves in a direction away from attachment coupling pin 17 and toward arm coupling pin 16, bucket 13 is rotationally driven around attachment coupling pin 17. Bucket 13 moves in the direction of dumping (the direction to move cutting edge 13A of bucket 13 away from arm 12; in FIG. 21, clockwise around attachment coupling pin 17).

Pinion 228 and pinion 238 are meshed with rack 240. Pinion 228 is connected to first motor 221, and as first motor 221 is rotationally driven, pinion 228 rotates. Pinion 238 is connected to second motor 231, and as second motor 231 is rotationally driven, pinion 238 rotates. Motive power transmission apparatus 210 in the second embodiment is driven with double-motor drive in which two motors, that is, first motor 221 and second motor 231, are used to drive rack 240 which is a single gear member.

As in the first embodiment, as first motor 221 and second motor 231 are controlled in coordination, backlash elimination control can be carried out to enhance accuracy in positioning of bucket 13. In order to improve efficiency of motive power transmission apparatus 210, backlash elimination control does not have to be performed.

A direction of rotation of first motor 221 and second motor 231 and drive force generated thereby are adjusted in accordance with an operation by the operator to operate bucket 13. The operator who is seated at operator's seat 4S can move bucket 13 in the direction of excavation by moving a control lever arranged on the right of operator's seat 4S with his/her right hand to the left or move bucket 13 in the direction of dumping by moving the control lever to the right. In accordance with the operator's intention, bucket 13 at the tip end of work implement 10 can be moved highly efficiently at a high speed, moved at a slow speed with high position accuracy, or come to rest with high position accuracy.

As shown in FIGS. 21 and 22, electric excavator 30 in the second embodiment described above includes attachment motor 220 that generates drive force to move bucket 13 relatively to boom 11. As bucket 13 is electrically driven without being driven by a hydraulic cylinder and the operation by bucket 13 is electrically powered, motive power can be reduced and a more environment-friendly work machine can be realized. Since the hydraulic cylinder is not used, influence by variation in hydraulic pressure can be lessened, influence by variation in kinematic viscosity characteristics due to variation in temperature of hydraulic oil can be lessened, and noise generated during works can be lowered.

As shown in FIGS. 21 and 22, electric excavator 30 includes motive power transmission apparatus 210. Motive power transmission apparatus 210 mechanically transmits drive force generated by attachment motor 220 to bucket 13. As drive force of attachment motor 220 is mechanically transmitted to bucket 13 without being converted to a hydraulic pressure, an amount of power consumption by attachment motor 220 can be reduced. Since a capacity of a battery mounted on vehicular body frame 3 can be reduced, space efficiency of vehicular body frame 3 can be improved. Cost for manufacturing and maintenance of electric excavator 30 can be reduced in conformity with reduction of the battery.

As shown in FIGS. 21 and 22, motive power transmission apparatus 210 includes rack 240 and pinions 228 and 238. As drive force from attachment motor 220 is transmitted to pinions 228 and 238 to rotationally drive pinions 228 and 238 and to cause rack 240 meshed with pinions 228 and 238 to carry out reciprocating movement in the longitudinal direction, bucket 13 can be rotated around attachment coupling pin 17.

As shown in FIGS. 21 and 22, motive power transmission apparatus 210 includes flexible shafts 222 and 232. As motive power is transmitted with the use of flexible shafts 222 and 232, accurate centering is not required and a mechanism can be simplified and low in cost.

As shown in FIG. 22, motive power transmission apparatus 210 includes planetary reduction gears 225 and 235. With the highly efficient planetary reduction gear, drive torque generated by attachment motor 220 can efficiently be transmitted to bucket 13. By adopting the highly efficient planetary reduction gear to allow external force to directly conduct to attachment motor 220 at the time of application of external force to bucket 13, break of planetary reduction gears 225 and 235 can be suppressed and a structure strong against impact can be obtained.

As shown in FIGS. 21 and 22, rack 240 and pinions 228 and 238 are supported by arm 12. As arm 12 supports rack 240 coupled to bucket 13 and pinions 228 and 238 meshed with rack 240, drive force generated by attachment motor 220 can reliably be transmitted to bucket 13 with a rack-and-pinion mechanism being interposed.

As shown in FIG. 21, attachment motor 220 is mounted on arm 12 with buffer mechanism 229 being interposed. For example, when external force is applied to bucket 13, buffer mechanism 229 can buffer impact to lessen external force transmitted to attachment motor 220, so that reliability of attachment motor 220 can be improved.

In the description of the second embodiment, an example in which attachment motor 220 is mounted on arm 12 is described. Attachment motor 220 may be mounted on vehicular body frame 3. By not mounting a heavy object on work implement 10, work implement 10 can be lighter in weight. By mounting the heavy object on vehicular body frame 3, stability of electric excavator 30 can be increased. Since impact transmitted to attachment motor 220 can be lessened by arranging attachment motor 220 at a position distant from bucket 13 on which loads are imposed during works, reliability of attachment motor 220 can be improved.

When accuracy in positioning of bucket 13 is not required as in the first embodiment, single-motor drive in which rack 240 is driven by a single motor can also be adopted.

In the first and second embodiments, electric excavator 30 including a motor that generates drive force for driving work implement 10 is described. Electric excavator 30 may be an electric vehicle where a motor generates also drive force for travel of traveling unit 5 and revolution of revolving unit 2 with respect to traveling unit 5. Electric excavator 30 does not have to include an internal combustion engine. Electric excavator 30 does not have to include a hydraulic circuit.

In the first and second embodiments, an example in which the motive power transmission apparatus includes a planetary reduction gear is described. Instead of the planetary reduction gear, the motive power transmission apparatus may include a spur gear reducer in which a single gear is meshed with a single gear and a plurality of gears are combined.

Third Embodiment

Electric excavator 30 based on a third embodiment is the same in overall construction as the electric excavator in the first embodiment described with reference to FIG. 1. Electric excavator 30 includes vehicular body frame 3. Electric excavator 30 includes work implement 10. Work implement 10 includes boom 11 supported by vehicular body frame 3 and bucket 13 movable relatively to boom 11.

Figure 23:
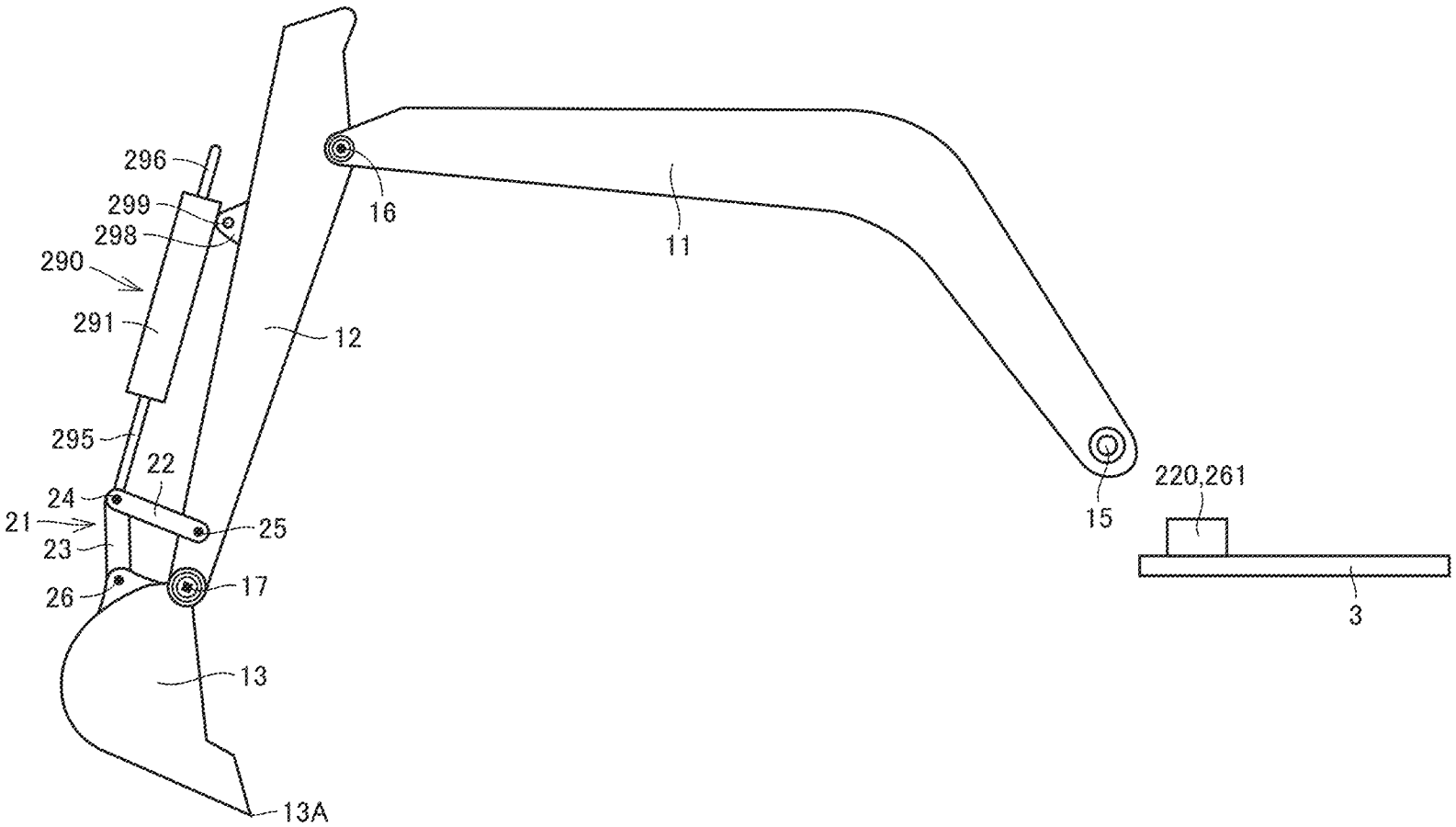
FIG. 23 is a diagram showing a general construction of a motive power transmission apparatus that transmits drive force to the bucket based on a third embodiment.

FIG. 23 is a diagram showing a general construction of a motive power transmission apparatus that transmits drive force to bucket 13 based on the third embodiment. In electric excavator 30 in the third embodiment, attachment motor 220 generates drive force to drive bucket 13. Attachment motor 220 can drive bucket 13. By being driven by attachment motor 220, bucket 13 can operate. As bucket 13 is driven by attachment motor 220, bucket 13 is rotatable relatively to arm 12 around attachment coupling pin 17.

Attachment motor 220 is mounted on vehicular body frame 3. A hydraulic pump 261 is mounted on vehicular body frame 3. By being driven by attachment motor 220, hydraulic pump 261 delivers pressure oil.

The motive power transmission apparatus in the third embodiment includes a double-rod cylinder 290 driven by pressure oil delivered by hydraulic pump 261. Double-rod cylinder 290 includes a cylinder portion 291, a first rod portion 295, and a second rod portion 296. Cylinder portion 291 is in a cylindrical shape and supported by arm 12. Arm 12 is provided with a bracket 298, and cylinder portion 291 is rotatably supported by bracket 298 with a support pin 299 being interposed. Double-rod cylinder 290 is supported by arm 12. Double-rod cylinder 290 is rotatable with respect to arm 12.

First rod portion 295 has a base end accommodated in cylinder portion 291 and has a tip end protruding to the outside of cylinder portion 291. First rod portion 295 has the tip end coupled to link pin 24 that couples first member 22 and second member 23 of bucket link 21. First rod portion 295 is coupled to bucket 13 with bucket link 21 being interposed. Second rod portion 296 has a base end accommodated in cylinder portion 291 and a tip end protruding to the outside of cylinder portion 291. Second rod portion 296 has the free tip end without being coupled to another member. First rod portion 295 and second rod portion 296 are each in a rod shape. First rod portion 295 and second rod portion 296 are identical to each other in diameter. First rod portion 295 and second rod portion 296 are equal to each other in area of a cross-section orthogonal to the longitudinal direction.

Figure 24:
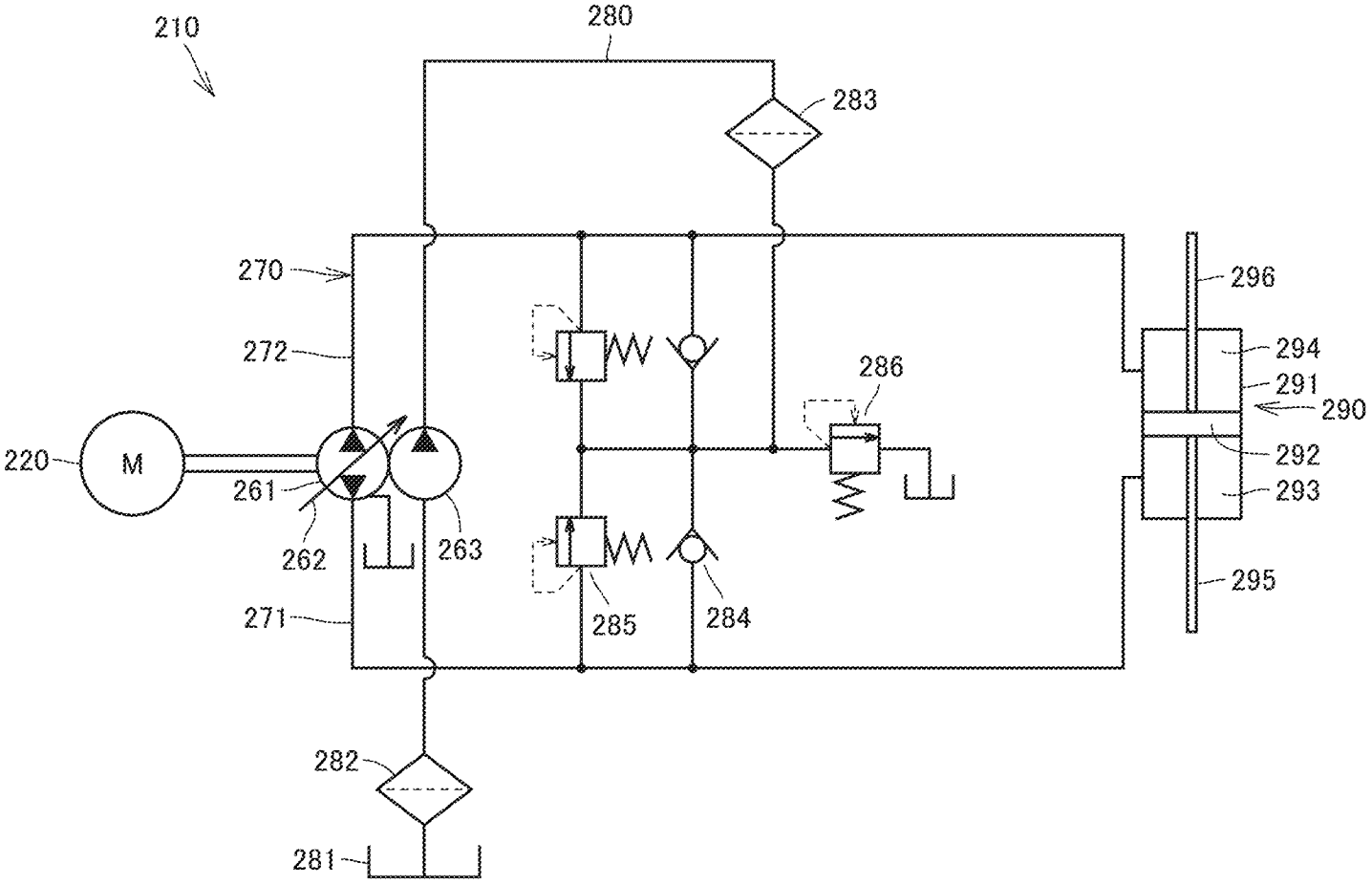
FIG. 24 is a schematic diagram of a hydraulic circuit that drives a double-rod cylinder.

FIG. 24 is a schematic diagram of a hydraulic circuit 270 that drives double-rod cylinder 290. As shown in FIG. 24, double-rod cylinder 290 includes a piston portion 292 accommodated in cylinder portion 291. Piston portion 292 can carry out reciprocating movement in the longitudinal direction (in FIG. 24, the upward/downward direction in the drawing) of cylinder portion 291 in the cylindrical shape. Piston portion 292 partitions an internal space in cylinder portion 291 into a first chamber 293 and a second chamber 294. First rod portion 295 has the base end coupled to piston portion 292. Second rod portion 296 has the base end coupled to piston portion 292.

Motive power transmission apparatus 210 that transmits drive force generated by attachment motor 220 to bucket 13 includes hydraulic circuit 270. Hydraulic circuit 270 is a closed hydraulic circuit (closed circuit) through which hydraulic pump 261 and double-rod cylinder 290 are connected to each other. Hydraulic circuit 270 includes a first oil path (first flow path) 271 and a second oil path (second flow path) 272.

First oil path 271 connects hydraulic pump 261 and first chamber 293 of double-rod cylinder 290 to each other. Hydraulic oil delivered by hydraulic pump 261 can be supplied to first chamber 293 through first oil path 271. Second oil path 272 is a flow path different from first oil path 271, and connects hydraulic pump 261 and second chamber 294 of double-rod cylinder 290 to each other. Hydraulic oil delivered by hydraulic pump 261 can be supplied to second chamber 294 through second oil path 272.

Hydraulic pump 261 is, for example, a swash-plate-type axial pump, and includes a variable swash plate 262. A driveshaft of hydraulic pump 261 is connected to an output shaft of attachment motor 220. An angle of variable swash plate 262 is steplessly and continuously controlled, for example, by an actuator such as a solenoid.

As attachment motor 220 is driven, the driveshaft of hydraulic pump 261 rotates. Hydraulic pump 261 thus pressurizes hydraulic oil in hydraulic circuit 270 to deliver pressure oil to one of first oil path 271 and second oil path 272. Hydraulic pump 261 converts drive force from attachment motor 220 into energy of hydraulic oil (fluid). This energy of hydraulic oil is transmitted to double-rod cylinder 290 through first oil path 271 or second oil path 272.

As energy of hydraulic oil is transmitted to double-rod cylinder 290, double-rod cylinder 290 is driven. Specifically, as pressure oil is supplied to first chamber 293 through first oil path 271, piston portion 292 moves to increase a volume of first chamber 293 and decrease a volume of second chamber 294. As pressure oil is supplied to second chamber 294 through second oil path 272, piston portion 292 moves to increase the volume of second chamber 294 and decrease the volume of second chamber 294. With this movement of piston portion 292, one of first rod portion 295 and second rod portion 296 protrudes from cylinder portion 291 and the other thereof retracts into cylinder portion 291.

During supply of pressure oil through first oil path 271 into first chamber 293, hydraulic oil that flows out of second chamber 294, the volume of which decreases with movement of piston portion 292, is supplied to hydraulic pump 261 through second oil path 272. During supply of pressure oil through second oil path 272 into second chamber 294, hydraulic oil that flows out of first chamber 293, the volume of which decreases with movement of piston portion 292, is supplied to hydraulic pump 261 through first oil path 271.

Hydraulic pump 261 can collect energy of supplied hydraulic oil as regenerative energy. As energy loss can be lessened, efficiency of motive power transmission apparatus 210 is improved.

A charge passage 280 serves to replenish hydraulic circuit 270 with hydraulic oil when a pressure of hydraulic oil in hydraulic circuit 270 becomes lower than a setting pressure. Hydraulic oil in a hydraulic oil tank 281 is pumped up by a charge pump 263 and hydraulic circuit 270 is replenished therewith. In replenishment of hydraulic circuit 270, hydraulic oil is cleaned by passing through a suction filter 282 and a line filter 283. Hydraulic circuit 270 is replenished with hydraulic oil in a cleaned and purified state.

Charge pump 263 is driven by attachment motor 220. Charge pump 263 is, for example, a swash-plate-type axial pump. By being driven by attachment motor 220, a drive-shaft of charge pump 263 rotates. Charge pump 263 replenishes each of first oil path 271 and second oil path 272 with hydraulic oil pumped up from hydraulic oil tank 281.

In a flow path for replenishment of first oil path 271 with hydraulic oil through charge passage 280, a check valve 284 and a relief valve 285 are arranged. In a flow path for replenishment of second oil path 272 with hydraulic oil through charge passage 280 as well, check valve 284 and relief valve 285 are arranged. Check valve 284 is a valve for setting hydraulic circuit 270 to a closed circuit. Relief valve 285 is a valve that restricts increase in pressure in hydraulic circuit 270. When a hydraulic pressure in hydraulic circuit 270 exceeds a setting pressure of relief valve 285, hydraulic oil in hydraulic circuit 270 flows into charge passage 280 through relief valve 285.

In a flow path for hydraulic oil delivered from charge pump 263, a charge relief valve 286 is arranged. Charge relief valve 286 regulates a pressure of hydraulic oil in first oil path 271 and second oil path 272 to be lower than a setting pressure. While each of the pressure of hydraulic oil in first oil path 271 and second oil path 272 is equal to or higher than the setting pressure of charge relief valve 286, hydraulic oil delivered from charge pump 263 returns to hydraulic oil tank 281 through charge relief valve 286.

As shown in FIG. 23, electric excavator 30 in the third embodiment described above includes attachment motor 220 that generates drive force to move bucket 13 relatively to boom 11. As attachment motor 220 is adopted as a source of drive of bucket 13 and the operation of bucket 13 is electrically powered, motive power can be reduced and a more environment-friendly work machine can be realized.

As shown in FIG. 23, attachment motor 220 is mounted on vehicular body frame 3. Attachment motor 220 that drives bucket 13 at the tip end of work implement 10 is not mounted on arm 12 but on vehicular body frame 3. As a heavy object is not mounted on work implement 10, work implement 10 can be lighter in weight. As the heavy object is mounted on vehicular body frame 3, stability of electric excavator 30 can be increased.

As attachment motor 220 is arranged at the position distant from bucket 13 on which loads are imposed during works, impact transmitted to attachment motor 220 can be lessened and hence reliability of attachment motor 220 can be improved. In works for dredging rivers and harbors, bucket 13 and arm 12 move into water. Submergence of attachment motor 220 mounted on vehicular body frame 3, however, does not have to be taken into consideration and attachment motor 220 can be simplified in construction.

As shown in FIGS. 23 and 24, motive power transmission apparatus 210 that transmits drive force generated by attachment motor 220 to bucket 13 includes hydraulic pump 261, double-rod cylinder 290 driven by pressure oil delivered by hydraulic pump 261, and hydraulic circuit 270 through which hydraulic pump 261 and double-rod cylinder 290 are connected to each other. A conventional hydraulic circuit that supplies hydraulic oil to a hydraulic cylinder includes a valve for controlling a flow rate of hydraulic oil, whereas hydraulic circuit 270 in the embodiment without including a valve controls a flow rate of hydraulic oil with the use of hydraulic pump 261. Since there is no pressure loss in the valve, efficiency of motive power transmission apparatus 210 can be improved.

Hydraulic oil equal in amount to hydraulic oil that enters one of first chamber 293 and second chamber 294 of double-rod cylinder 290 flows out of the other chamber. Energy of hydraulic oil that flows out can be collected by attachment motor 220 as regenerative energy. Since energy loss can be reduced, efficiency of motive power transmission apparatus 210 can further be improved. As bucket 13 is driven with the use of double-rod cylinder 290 driven by the closed hydraulic circuit, motive power can be reduced and a more environment-friendly work machine can be realized.

Hydraulic circuit 270 supplies hydraulic oil only to double-rod cylinder 290 for driving bucket 13. Hydraulic circuit 270 is an independent circuit that does not supply hydraulic oil to other apparatuses such as boom 11, arm 12, a revolution motor, and a travel motor and it is not interfered by other circuits, so that accuracy in positioning of cutting edge 13A of bucket 13 can be improved.

As shown in FIGS. 23 and 24, double-rod cylinder 290 includes first rod portion 295 and second rod portion 296. First rod portion 295 and second rod portion 296 have their base ends fixed to piston portion 292 and have their tip ends protruding to the outside of cylinder portion 291. By setting an area of piston portion 292 that forms an inner surface of first chamber 293 to be equal to an area thereof that forms an inner surface of second chamber 294, hydraulic oil equal in amount to hydraulic oil that enters one of first chamber 293 and second chamber 294 can reliably flow out of the other chamber. A velocity of flow of oil that enters first chamber 293 can be equal to a velocity of flow of oil that flows out of second chamber 294.

As shown in FIG. 24, hydraulic circuit 270 includes first oil path 271 that connects hydraulic pump 261 and first chamber 293 of double-rod cylinder 290 to each other and second oil path 272 that connects hydraulic pump 261 and second chamber 294 of double-rod cylinder 290 to each other. Pressure oil delivered from hydraulic pump 261 can be supplied to first chamber 293, for example, through first oil path 271, and at this time, hydraulic oil in the same amount can flow out of second chamber 294 and return to hydraulic pump 261 through second oil path 272.

As shown in FIG. 23, double-rod cylinder 290 is supported by arm 12. As double-rod cylinder 290 that drives bucket 13 is supported by arm 12 to which bucket 13 is coupled, bucket 13 can reliably operate as first rod portion 295 of double-rod cylinder 190 carries out reciprocating movement relatively to cylinder portion 291.

As shown in FIG. 23, double-rod cylinder 290 is rotatable with respect to arm 12. An angle formed by a direction of extension of double-rod cylinder 290 with respect to arm 12 can change, as following the operation of bucket 13 that rotates with respect to arm 12. Thus, double-rod cylinder 290 can be supported by arm 12 regardless of the posture of bucket 13, and bucket 13 can reliably operate with motion of first rod portion 295 of double-rod cylinder 290.

Though electric excavator 30 is exemplified as an exemplary work machine in the embodiments so far, the technical concept of the present disclosure is applicable also to a work machine of another type including an articulated work implement such as a wheel loader, without being limited to electric excavator 30.

Though embodiments have been described as above, features that can be combined in each embodiment may be combined as appropriate. It should be understood that the embodiments disclosed herein are illustrative and non-restrictive in every respect. The scope of the present invention is defined by the terms of the claims rather than the description above and is intended to include any modifications within the scope and meaning equivalent to the terms of the claims.

REFERENCE SIGNS LIST

1 vehicular body; 2 revolving unit; 3 vehicular body frame; 4 operator's cab; 4L control lever; 4L1 root portion; 4L2 grip portion; 4S operator's seat; 7, 8 vertical plate; 10 work implement; 11 boom; 12 arm; 13 bucket; 13A cutting edge; 15 boom foot pin; 16 arm coupling pin; 17 attachment coupling pin; 21 bucket link; 22 first member; 23 second member; 24, 25, 26 link pin; 30 electric excavator; 100 electric motor; 110 boom motor; 111 first boom motor; 112, 122, 227, 237 output shaft; 113, 123, 225, 235 planetary reduction gear; 114, 124 sun gear; 115, 125 planetary gear; 116, 126 ring gear; 117, 127 geared motor; 118, 128 coupling shaft; 119 first boom output gear; 121 second boom motor; 129 second boom output gear; 131 boom gear member; 140 arm motor; 141 first arm motor; 149 first arm output gear; 151 second arm motor; 159 second arm output gear; 160, 210 motive power transmission apparatus; 161 arm gear member; 162 pivot member; 170 arm link; 171 first link member; 172 second link member; 173 intermediate member; 174, 175, 176, 177 coupling pin; 220 attachment motor; 221 first motor; 222, 232 flexible shaft; 223, 224, 233, 234 bevel gear; 228, 238 pinion; 229 buffer mechanism; 231 second motor; 240 rack; 250 support member; 261 hydraulic pump; 270 hydraulic circuit; 271 first oil path; 272 second oil path; 280 charge passage; 281 hydraulic oil tank; 290 double-rod cylinder; 291 cylinder portion; 292 piston portion; 293 first chamber; 294 second chamber; 295 first rod portion; 296 second rod portion; 298 bracket; 299 support pin

The invention claimed is:

1. A work machine comprising:

a vehicular body frame;

a work implement including a boom supported by the vehicular body frame, an arm coupled to the boom, and an attachment coupled to the arm;

a boom foot pin that rotatably couples the boom to the vehicular body frame;

an electric motor supported by the vehicular body frame, the motor generating drive force that moves the arm relatively to the boom; and a motive power transmission apparatus that mechanically transmits drive force generated by the motor to the arm, wherein the motive power transmission apparatus includes:

a first transmission member that carries out rotational motion relative to the vehicular body frame as being concentric with the boom foot pin, and a second transmission member that transmits motive power to the arm as a result of the relative rotational motion of the first transmission member, wherein the second transmission member includes:

an intermediate member connected to the boom, a rod-shaped first link member extending along an outer side of the boom and coupled to the intermediate member, the first rod-shaped link member transmitting drive force to the intermediate member, and a rod-shaped second link member extending along the outer side of the boom and coupling the intermediate member and the arm to each other.

2. The work machine according to claim 1, further comprising a planetary reduction gear that decelerates rotation of the motor to increase drive force and outputs increased drive force.

3. The work machine according to claim 2, wherein the motor and the planetary reduction gear constitute an integrated structure.

4. The work machine according to claim 1, wherein the first transmission member includes a gear member rotatable around the boom foot pin, the work machine further comprises:

a first output gear meshed with the gear member; and a second output gear meshed with the gear member, and the motor includes a first motor that transmits drive force to the first output gear, and a second motor that transmits drive force to the second output gear.

5. The work machine according to claim 4, further comprising an operation apparatus operated to operate the work implement, wherein a direction of rotation of the first motor and the second motor and drive force generated by the first motor and the second motor are adjustable in accordance with an operation onto the operation apparatus.

6. The work machine according to claim 1, further comprising a boom motor supported by the vehicular body frame, the boom motor generating drive force that moves the boom relatively to the vehicular body frame.

7. The work machine according to claim 6, further comprising:

a boom gear member rotatable around the boom foot pin;

a first boom output gear meshed with the boom gear member; and a second boom output gear meshed with the boom gear member, wherein the boom motor includes a first boom motor that transmits drive force to the first boom output gear, and a second boom motor that transmits drive force to the second boom output gear.

8. The work machine according to claim 7, wherein the boom gear member is fixed to a side surface of the boom.

9. The work machine according to claim 1, wherein the first link member and the second link member are rigid bodies that do not expand and contract.

10. The work machine according to claim 1, wherein the intermediate member is in a polygonal shape, and the first link member and the second link member are coupled to the intermediate member adjacent to different vertices of the polygonal shape of the intermediate member.

11. The work machine according to claim 1, wherein the first link member is disposed in parallel with the boom, and the second link member is disposed in parallel with the boom.

* * * * *